United States Patent [19]

Mueller

[11] 4,065,909

[45] Jan. 3, 1978

[54] METHOD AND APPARATUS FOR APPLYING A LID AND TAMPER-INDICATING SHEET TO A CONTAINER

[75] Inventor: Martin Mueller, Wonderlake, Ill.

[73] Assignee: Owens-Illinois, Inc., Toledo, Ohio

[21] Appl. No.: 680,466

[22] Filed: Apr. 26, 1976

[51] Int. Cl.[2] ..... B65B 7/28

[52] U.S. Cl. ..... 53/15; 53/41; 53/128; 53/129; 53/296; 53/307; 53/319; 53/329

[58] Field of Search ..... 53/38, 41, 42, 14, 307, 53/15, 296, 298, 329, 170, 319, 173, 175

[56] References Cited

U.S. PATENT DOCUMENTS

| | | | |
|---|---|---|---|
| 3,243,934 | 4/1966 | Kinney | 53/42 X |
| 3,509,682 | 5/1970 | Logemann | 53/307 X |
| 3,621,637 | 11/1971 | Sternau | 53/329 |
| 3,628,307 | 12/1971 | Croasdale et al. | 53/307 X |
| 3,657,862 | 4/1972 | Milne | 53/329 X |
| 3,712,023 | 1/1973 | Bryan et al. | 53/307 |
| 3,890,767 | 6/1975 | Cawrse | 53/307 X |
| 3,939,625 | 2/1976 | Remele et al. | 53/307 X |
| 3,955,006 | 5/1976 | Sokolsky et al. | 53/38 X |

*Primary Examiner*—Travis S. McGehee
*Assistant Examiner*—Horace M. Culver
*Attorney, Agent, or Firm*—David R. Birchall; Myron E. Click

[57] ABSTRACT

A method and apparatus for applying a closure to a receptacle is disclosed wherein an open top receptacle is moved along a processing path on an indexing conveyor and an outer lid and flexible inner closure sheet are placed together and on the open receptacle by a rotatably indexing, horizontally mounted drum assembly with a generally hexagonal exterior presenting six faces which each comprises a closure sheet carrier plate. Mounted within a central recess in each sheet carrier plate is a lid carrier plate which is movable between a seated position within the sheet carrier plate and an extended position displaced from the sheet carrier plate. A continuous strip of closure sheet is maintained adjacent one side of the drum assembly between the drum assembly and an intermittently driven cutter. In operation, the drum assembly is rotatably indexed in a first 60° increment to present a lid carrier plate at the top of the drum assembly, which lid carrier plate is then extended to receive a lid from a lid dispensing assembly mounted above the drum assembly. By vacuum holding action, the lid carrier assembly secures a lid from the lid dispensing assembly and is returned to the seated position on the sheet carrier plate. During a second 60° indexed rotation, the drum face bearing the lid is brought into contact with the strip of closure sheet which, by vacuum means, is held against the face of the drum assembly superposed upon the lid and sheet carrier plate. After a third indexed rotation, the strip is severed by a cutter to leave a square-shaped sheet superposed upon the lid on the face of the drum assembly. The drum assembly is then rotatably indexed a fourth time to bring the lid and square sheet to the bottom of the drum assembly and in alignment over an open top receptacle. The lid carrier plate is then moved to the extended position forcing the lid and closure sheet into the open top of the receptacle, following which the vacuum hold on the lid is terminated and the lid carrier plate is returned to the seated position in the film carrier plate.

36 Claims, 14 Drawing Figures 134
132
16
182
194
160
232
230
244
132
338
340
336
334
342
332
330
346
344
328
324
24
50
120
22
20

METHOD AND APPARATUS FOR APPLYING A LID AND TAMPER-INDICATING SHEET TO A CONTAINER

BACKGROUND OF THE INVENTION

This invention relates to a method and apparatus for applying a closure to an open top receptacle. More particularly, it relates to applying a flexible sheet of film-like material over the top of an open container and superposing an outer lid over the flexible closure sheet to form the completed closure. Containers thus formed are generally used in the food packaging industry and embody various shapes and forms for packaging various food products, particularly of the flowable type.

Cottage cheese, butter, yogurt and similar food-stuffs are commonly packaged and marketed in a container that is generally wax-coated or wax-impregnated paper or plastic. The container has a receptacle portion, consisting of a base and upwardly extending sidewall, and an outer closure lid which is pressed into the sidewall top peripheral opening, or mouth, as snuggly as possible so as to minimize the entry of air or the escape of food-stuff from the closed container. Outer closure lids for such containers are either the plain disc-like lids which engage a peripherally extending bead located below the mouth rim on the container on the interior surface of the sidewalls, or so-called flush-type which fit across the opening of the container and have a depending skirt or snap-on engagement with an exterior portion of a beaded rim on the container, or so-called plug-type lids which project into the interior of the container adjacent the inner surface of the upwardly extending sidewall and engage the sidewall opening in snap-on relation.

Conventionally, with containers of this type, it is relatively easy for the consumer, or other person, to remove the outer lid, and because of this, innocent, or willful and malicious tampering with the container's internal contents is possible.

It is also known to package food-stuffs of the type mentioned above in a "double-seal" container wherein a flexible sheet is secured to the undersurface of the lid and to the mouth of the receptacle. Such containers are also susceptible to tampering since, after removing the outer lid closure, a potential consumer may lift up a portion of the flexible sheet closure from engagement with the top of the container. With such containers, it is possible to determine if the flexible sheet closure has been loosened from the top of the container, but only by lifting the outer closure lid from the container and performing a close inspection.

In known containers which include a flexible sheet inner closure underneath the lid, such as those disclosed in U.S. Pat. Nos. 3,301,464; 3,338,027 and 3,471,992, a thin film or sheet of flexible material is disposed across the opening of the top of the container and is in contact with, and supported by, the top peripheral surfaces of the rim of the container. With those containers employing plug-type lids, the plug-type lid presents a substantially vertical and peripherally-extending wall area, which will lie adjacent to the interior surface of the container sidewall immediately below the top edge of the rim of the container when the lid is placed thereon. This vertically disposed peripheral wall area of the plug-type lid will engage a portion of the flexible sheet film and press it against the interior surface of the sidewall of the container. In some containers, the flexible sheet closure is heat-sealed to the portion of the container sidewall adjacent the vertical and peripherally extending wall area of the plug-type lid. In other containers, the flexible sheet closure material may be heat-sealed across the upper surface of the rim of the container. Further, instead of heat-sealing, adhesive means can be employed.

While such double-seal containers have functioned generally satisfactorily, several problems have been encountered, both in manufacture and in ultimate use. With respect to manufacturing, in accordance with known techniques, it is necessary to cut the sheet closure to a relatively precise size and shape corresponding to the size and shape of the container lid and the mouth of the container. And, it is necessary to maintain the sheet in relatively precise registry with the lid and to secure the sheet to the lid prior to insertion of the lid into the mouth of the container. The strength of the attachment between the lid and sheet must be accurately controlled to prevent the lid from tearing the sheet when the lid is removed, as for example, to check the tamper-proof integrity of the container. And, since the sheet does conform in size and shape to the lid and mouth of the container, there are no readily graspable tabs to facilitate removal of the sheet when it is desired to get access to the contents of the container.

Owing to the possibility and easy of opening of the flexible sheet closure, as a result of inadvertent shipping and handling activities or as a result of innocent potential consumer curiosity or malicious tampering, it is desirable to be able to more easily determine if the flexible sheet closure has been opened. Further, it is desirable that a tamper-indicating construction be employed with such flexible sheet closures that will allow the closure to be used with many types of lids and containers now in use. Advantageously, such a tamper-indicating construction of a flexible sheet closure should be effective regardless of the manner of engagement of the closure with the upper rim of the container. That is, the tamper-indicating flexible sheet closure construction should be effective regardless of whether or not the flexible sheet closure is heat-sealed or adhesively secured to the top rim of the container or just non-sealingly supported thereon. Further, it is desirable that the tamper-indicating construction of the flexible sheet closure not require visual inspection through complicated, relatively more expensive, transparent windows in the outer closure lid when such outer closure lid is used. The tamper-indicating flexible sheet closure construction should also work with a large variety of different types of flexible sheet materials that may be used.

With apparatus used for automatically assembling tamper-indicating containers, it is desirable that the lid and inner flexible closure sheet be conveniently assembled and placed on the open top receptacle portion of the container at one station. This would avoid having to assemble the lid and flexible closure sheet, as by adhesively or heat-sealingly securing them together, at a first station and then stacking, storing, and transporting them to a second station where they would be placed on the receptacle. The advantages of bypassing such a separate step, besides the obvious savings in time and labor, is that this eliminates the danger of separating the flexible sheet from the lid or otherwise damaging the lid/closure sheet assembly during the stacking storing, and transporting steps.

With apparatus used for automatically assembling tamper-indicating containers, it is also desirable to eliminate any requirement for securing the lid and flexible closure sheet together, as with adhesive or a heat-seal, since this would eliminate a certain amount of complexity from the apparatus. Further, in apparatus used for assembling frusto-conical containers, it would be desirable to eliminate the requirements for the close tolerances required to cut a circular sheet of flexible closure material and precisely align it with the lid.

SUMMARY OF THE INVENTION

The present invention embodies a method and apparatus for assembling a novel tamper-indicating sheet closure for a container having an opening on one end. The container contemplated by this invention comprises a base with a sidewall extending upwardly from the periphery of the base and defining a substantially circular open top, or mouth. For use with the preferred embodiment of the apparatus of this invention, the mouth of the container is preferably circular and the sidewall is preferably frusto-conical. The mouth is defined by an outwardly rolled beaded rim. Disposed across the rim is a sheet of flexible, film-like material which has a square-shape and wherein the length of each side of the square is at least equal to the outer diameter of the container rim. With some types of closures, such as the plug-type, the length of each side of the square of sheet closure material must be somewhat greater than the outer diameter of the container rim as will be explained hereinafter. The tamper-indicating closure sheet is placed across the container rim so that it covers all points on the container rim and so that the corners of the square sheet project beyond the outer periphery of the rim.

For use with the preferred embodiment of the apparatus of this invention, the tamper-indicating closure sheet is a thin plastic film which is wax-coated on at least one surface. The wax-coating is heat-sensitive and adapted for being heat-sealed to the exterior surface of the sidewall of the container in the manner described and claimed in my commonly assigned, concurrently filed application Ser. No. 680,467, entitled "Method and Apparatus For Sealing Tamper-Indicating Tabs to a Container Sidewall." The container of the above-mentioned application, and of the present application, includes an outer closure lid of the plug-type that is engaged with the rim and upper portion of the container sidewall. The closure sheet is pressed between, and engaged by, the container rim on one surface of the sheet and by the outer closure lid on the other surface of the sheet. The corners of the closure sheet project outwardly from the periphery of the outer closure lid. The corners are preferably heat-sealed to the exterior surface of the sidewall of the container by apparatus as disclosed in the above-mentioned application, the disclosure of which is hereby incorporated herein by this reference.

In the container assembled by the method and apparatus of the present invention, the outer closure lid is not secured to the tamper-indicating closure sheet. Thus, the outer closure lid can be relatively easily removed without tearing or pulling away the flexible closure sheet. If the outer closure is removed wholly or partially from the container, the container contents are still protected by the tamper-indicating closure sheet disposed across the container opening beneath the outer closure lid. To gain access to the interior content of the container, it is required to remove, at least partially, the tamper-indicating closure sheet. The common method of removing the tamper-indicating closure sheet would be to grasp one of the corners that is heat-sealed to the exterior surface of the container sidewall and to pry it away, or pull it away, from the sidewall by breaking the heat-seal and then lifting up the closure sheet by pulling the corner further upwards above the top of the container. After this has been done, and the tamper-indicating closure sheet is subsequently lowered onto the rim of the container and the outer closure lid is subsequently engaged about the rim of the container over the closure sheet, then the loosened corner of the tamper-indicating closure sheet will not be sealed to the exterior wall of the container. This provides visual indication that the container has been opened. Note that the visual indication of tampering is thus determinable without removing the outer closure lid and without requiring the use of a transparent window, or other such device, in the outer closure lid.

The apparatus comprises a rotatably indexing, horizontally mounted drum assembly (sometimes referred to herein as a transfer member) with a hexagonal exterior surface, in each flat surface of which is mounted a closure film sheet carrier plate. Mounted within a central recess in each closure film sheet carrier plate is a lid carrier plate (sometimes referred to herein as a pick-up member) which is movable between a seated position within the closure film sheet carrier plate and an extended position outward from the closure film sheet carrier plate.

Mounted above the drum assembly is a bulk roll of the flexible plastic closure material. The bulk roll is mounted for rotation to permit feeding of a strip of closure sheet material downwardly and adjacent the drum assembly. A continuous strip of the closure sheet is maintained adjacent one side of the drum assembly between the drum assembly and a cutter.

An intermittently driven indexing conveyor passes beneath the drum assembly and carries open top receptacles which have been filled at a station upstream.

Closure lids are arranged in a conventional stacked lid dispensing assembly mounted above the drum assembly.

In operation, the drum assembly is rotated to present a lid carrier plate at the top of the drum assembly and the lid carrier plate is extended to receive a lid from a lid dispensing assembly mounted above the drum assembly. The lid carrier plate secures a lid from the lid dispensing assembly by vacuum holding action and is then moved to the seated position on the closure film sheet carrier plate. The drum assembly is then rotatably indexed 1/6 of a full rotation, or 60°, so that the face of the drum bearing the lid is brought into contact with the closure sheet strip which, by vacuum, is held against the face of the drum assembly superposed upon the lid. After another 60° indexed rotation, the closure sheet strip is severed by a cutter to leave a square-shaped closure sheet superposed upon the lid on the face of the drum assembly. The drum assembly is then rotatably indexed another 60° to bring the face bearing the lid and square-shaped closure sheet to a bottom position aligned over an open top receptacle on the conveyor. The lid carrier plate is then moved to the extended position forcing the lid and closure sheet into the open top of the receptacle, following which the vacuum hold on the lid is terminated and the lid carrier plate is withdrawn from the top of the receptacle and returned to the seated position in the closure sheet carrier plate. The container, with the corners of the square closure sheets projecting from the periphery of the lid, is then moved forward by the conveyor for subsequent processing, including heat-sealing the closure sheet to the interior of the rim of the container and further securing, or heat-sealing, the projecting corners of the closure sheet to the exterior surface of the container. These subsequent processing steps are preferably performed by the apparatus disclosed in the previously mentioned copending application entitled "Method and Apparatus for Sealing Tamper-Indicating Tabs to a Container Sidewall."

Numerous other advantages and features of the present invention will become readily apparent from the following detailed description of the invention and of one embodiment thereof, from the claims, and from the accompanying drawings in which each and every detail is fully and completely disclosed as part of the specification.

BRIEF DESCRIPTION OF THE DRAWINGS

In the accompanying drawings forming part of the specification, and in which like numerals are used to designate like parts throughout the same.

DESCRIPTION OF THE PREFERRED EMBODIMENT

Figure 1:
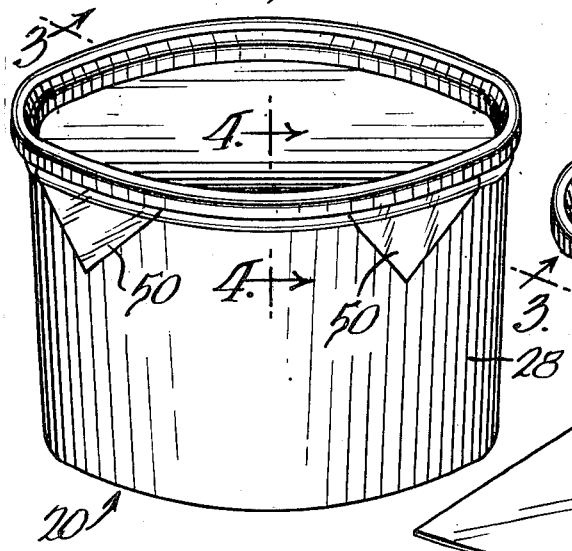
FIG. 1 is a perspective view of a filled and sealed container which is assembled by the apparatus of this invention.

While this invention is susceptible of embodiment in many different forms, there is shown in the drawings, and will herein be described in detail, a preferred embodiment of the invention, with the understanding that the present disclosure is to be considered as an exemplification of the principles of the invention and is not intended to limit the invention to the embodiment illustrated. The scope of the invention will be pointed out in the appended claims.

For ease of description, the apparatus of this invention will be described in normal operating position, and terms such as upper, lower, horizontal, etc., will be used with reference to this normal operating position. It will be understood, however, that apparatus of this invention may be manufactured, stored, transported and sold in orientation other than the normal operation position described.

Figure 2:
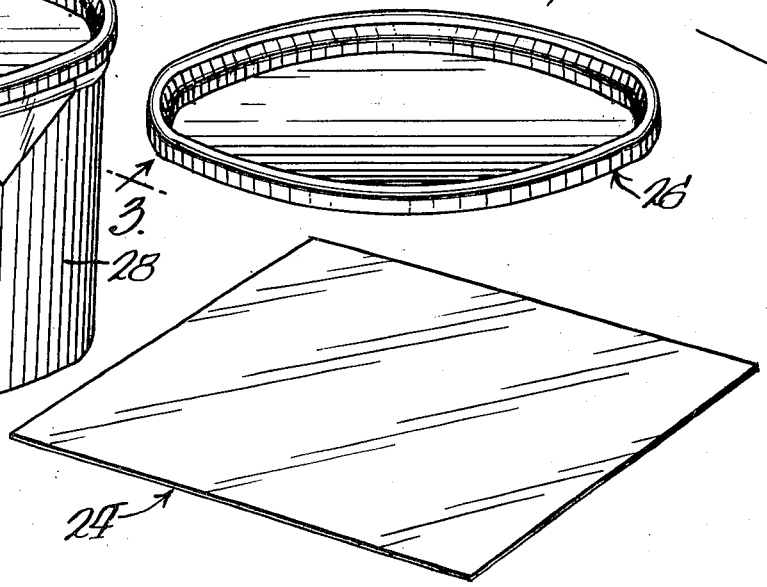
FIG. 2 is an exploded perspective view of the container of FIG. 1.
Figure 4:
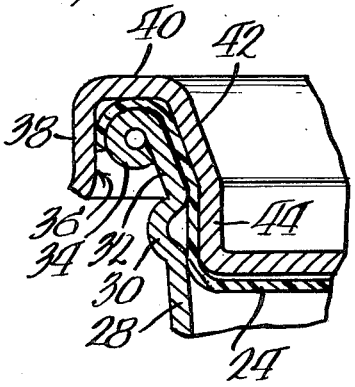
FIG. 4 is an enlarged fragmentary sectional view taken along plane 4—4 of FIG. 1.
Figure 4:
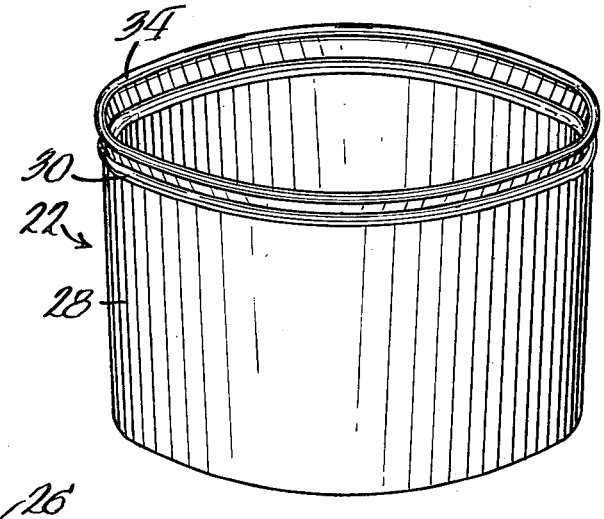

The present invention relates to formation of containers, as described and claimed in my concurrently filed copending application Ser. No. 680,465, entitled "Container with Sealed Tamper-Indicating Pull Tabs." The container is illustrated in FIGS. 1 through 4. Referring first to FIG. 1 of the drawings, the container is generally indicated by reference numeral 20. As shown in FIG. 2, the container is comprised of three major elements: a lower receptacle portion 22, a flexible quadrilaterally-shaped closure sheet 24 disposed across a mouth of the container receptacle portion 22, and an outer closure means in the form of lid 26.

As illustrated in FIG. 1, corners or tabs 50 of the flexible closure sheet 24 extend downwardly along the exterior of the receptacle portion 22 and are sealed or secured thereto. The container with a tamper-indicating closure sheet thus provides a novel but simple means for determining if the container has been opened. It is very easy to determine if the container has been opened by merely observing the integrity or condition of the attachment or seal of highly visible sheet corners to the container wall. The outer closure lid need not be removed from the container in making this observation.

Figure 3:
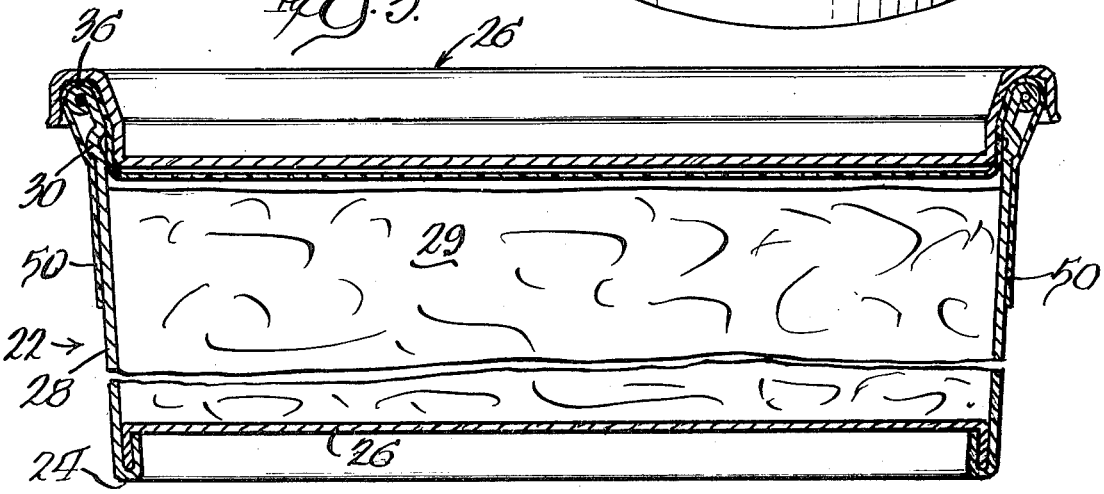
FIG. 3 is an enlarged cross-section view of the container taken along plane 3—3 of FIG. 1.

The receptacle portion 22 is made of wax-coated paper, although it will be understood that the receptacle portion might also be made of other materials. As illustrated in FIG. 3 of the drawings, the receptacle portion 22 is basically frusto-conically shaped and includes a circular base 24 depending downwardly from, and supporting bottom portion 26. Sidewall 28 extends upwardly from the base 24 and defines an open top or mouth. The receptacle portion 22 is shown in FIG. 3 as containing a food-stuff such as a flowable liquid, generally indicated by reference numeral 29.

In the upper portion of sidewall 28 near the top edge of the sidewall 28 is a peripherally extending and outwardly projecting bead 30. Since bead 30 has a cross-section that is curved with respect to the straight cross-section of sidewall 28, more sidewall material is present per unit height of the sidewall in a shape that gives that portion of the sidewall a greater section modulus thereby strengthening the sidewall against buckling and/or bending. Bead 30 may also function to receive a projecting, mating, lid-locking bead from a plug-type lid (not shown) that could be used in place of the preferred lid 26 illustrated and described herein. Depending on the type of lid used and depending upon the thickness of sidewall 28 and upon the height of the container 20, bead 30 may be omitted.

Extending upwardly and outwardly flared, or conically tapered, from bead 30 is wall 32 which serves to guide and seat lid 26 in place on the container 20.

The mouth of the receptacle portion 22 is defined by a conventional outwardly rolled beaded rim 34. Rim 34 provides additional rigidity and strengthens the sidewall 28 against buckling and bending. Rim 34 also serves as a support for flexible closure sheet 24 and lid 26.

In the preferred embodiment, lid 26 is of the plug-type and is of one-piece construction. Lid 26 is generally disc-shaped and has an annular channel which opens downwardly about the periphery of the lid for receiving the rim 34 of the container 20. The annular channel is designated generally as reference numeral 36 in FIG. 4. The annular channel 36 has three walls: an outer depending peripheral skirt 38, a flat top wall 40, and a slanting inner wall 42. Extending from and below slanting inner wall 42 in a substantially vertical orientation is vertical wall 44. Inner wall 42 is outwardly flared or conically tapered to join top wall 40 with vertical inner wall 44.

In the capped or covered container illustrated in FIG. 1, flexible closure sheet 24 is disposed across the mouth of receptacle portion 22 and contacts beaded rim 34 at all points on the periphery of the rim 34. Closure sheet 24 is generally centered over the mouth of the container and preferably has a square shape with the length of the sides of the square being slightly greater than the outer diameter of the rim. With the opening of the container completely covered by closure sheet 24, the lid 26, when in place on the container, engages the sheet 24 against the beaded rim 34 along the entire periphery of the mouth of the container. To this end, the inner mating surfaces of the walls 38, 40 and 42 of the annular channel 34 press against the upper surface of flexible closure sheet 24 and urge the sheet 24 into conformable contact engagement with container rim 34 and container wall 32.

As illustrated in FIG. 1, corners 50 project from below lid 26 and extend downwardly adjacent sidewall 28. Each of the four corners thus forms a tamper-indicating pull tab. The corners, or tabs 50, are secured to the sidewall 28 by an attachment means, joint, connection, or other affixation that permits the tabs to be peeled away from sidewall 28 and not become reattached. In the preferred embodiment, the corners or tabs 50 of the flexible sheet 24 are heat-securable, as by a heat-sealable wax coating, to the sidewall 28. In any case, the tabs 50 are each secured to the sidewall by suitable means. To open the container 20, it is necessary to first remove lid 26. Following removal of lid 26, one or more of the four tabs 50 must be removed from the secured engagement with the sidewall 28. Generally, this would be accomplished by a person putting the edge of a fingernail along the edge of a tab and prying the tab away from secured engagement with the sidewall 28. When enough of the tab 50 has been pried away, the pried away portion can be grasped between the thumb and index finger and pulled away from the sidewall 28 in an upward direction to pull the remaining portion of the tab 50 completely away from sidewall 28. By continued pulling on one of the tabs 50, the entire flexible closure sheet 24 can be lifted off of the container. Should one of the tabs 50 tear while it is being pulled, three other tabs are available for pulling.

When assembled by the apparatus of the preferred embodiment of this invention, flexible closure sheet 24 remains unattached or unsecured to lid 26. The flexible closure sheet 24 need not be secured in any way to the lid 26. That is, there need be no adhesive or heat-sealable bond between the under surface of lid 26 and flexible closure sheet 24. Preferably, closure sheet 24 is coated on the one side facing away from the lid 26 with a heat-securable coating. The heat-securable coating serves two purposes: (1) closure sheet 25 can be heat-secured to the wall 32 of the inner surface of sidewall 28 and (2) the corners or tabs 50 can be heat-secured to the exterior surface of sidewall 28. Depending on the materials used in the construction of the sidewall and/or upon the coating thereon, and upon the type of heat-securable coating on the flexible closure sheet 24, the heat-secured attachment of the closure sheet 24 to the container may or may not be gas-tight or liquid-tight. The flexible closure sheet 24 need not be sealed at all to the rim or wall 32 of the upper portion of the container sidewall 28. However, the corners or tabs 50 must be secured to the exterior surface of the sidewall 28 to function as tamper-indicating tabs as contemplated in this invention.

The flexible closure sheet can be made of a variety of materials, such as cellophane, plastic film, foil, or paper. The sheet can be transparent, translucent, or opaque, and can be adapted for receiving printed matter. Further, the flexible sheet 24 may be comprised of two or more laminated layers of different material. The flexible closure sheet 24 formed by this invention is preferably quadrilateral or square for ease of fabrication from rolls of sheet material whereby a quadrilateral or square sheet can be formed by simply making parallel cuts in the length of sheet material as it is pulled from a bulk roll.

Figure 5:
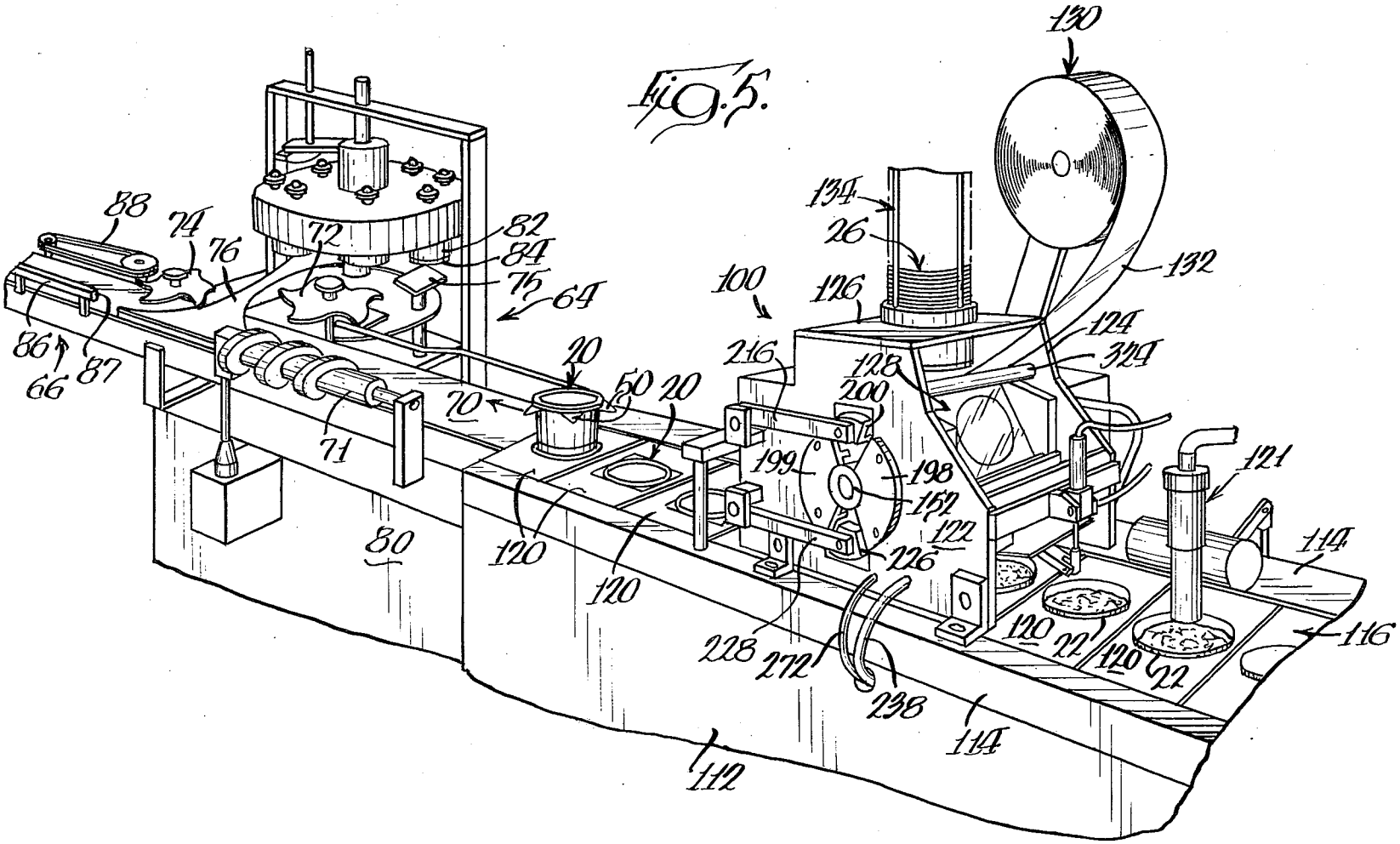
FIG. 5 is a perspective view of the apparatus of this invention.

Turning now to the method and apparatus for forming the container, and referring particularly to FIG. 5, the apparatus of the present invention is illustrated as forming a processing line including the apparatus described in the aforementioned copending application. First in the line is the container assembly apparatus which is designated by reference numeral 100. The container assembly apparatus 100 assembles a lid and closure sheet together on an open top receptacle in an unsealed manner. Forming part of a continuous process path, and located downstream of container assembly apparatus 100 is the lid sealing station 64. The tab securing, or tab sealing station 66 is located downstream of, and adjacent to, lid sealing station 64.

The container assembly apparatus 100 has a base frame 112 which houses certain conventional drive mechanisms which, though not fully illustrated or described, will be apparent to those having skill in the art and understanding of the necessary functions of such drive mechanisms causing proper operation of the machine or apparatus in the manner as will be explained.

The base frame 112 supports a conveyor frame 114 which consists of two parallel members spaced apart for receiving and supporting conveyor 116. Conveyor 116 is comprised of an articulated array of flat plates 120. Each plate 120 has a carrying hole for receiving an open top receptacle 22. The conveyor 116 is intermittently driven from right to left as viewed in FIG. 5 by a suitable conventional indexing means (not shown). Forward of container assembly apparatus 100 is a filling device 121 of known design for dispensing a desired volume of product into a receptacle positioned therebelow, and as a conveyor plate 120, holding the receptacle 22 is indexed beneath filling device 121, the receptacle is filled.

To aid in understanding of the present invention, before describing in detail the elements comprising the container assembly apparatus 100, a short summary or general description of the apparatus and its operation will be given. As illustrated in FIG. 5, the container assembly apparatus 100 is supported by, and partially housed in, front side frame member 122 and rear side frame member 124 and top frame member 126. Within the frame members, and mounted in frame members 122 and 124 for rotation about a horizontal axis is a lid transfer member in the form of a drum assembly 128 having a generally hexagonal exterior surface. One hexagonal face of the drum assembly is visible in FIG. 5 and two other faces are visible in FIG. 6. The hexagonal exterior surface shape can be seen in the side elevation view of FIG. 7, where the drum assembly 128 is shown in dashed lines. Mounted from side frame member 124, and above top frame member 126, is a bulk roll 130 of flexible closure material, such as plastic sheet coated on one side with heat-sealable wax. The bulk roll 130 is mounted in a conventional manner for rotation to permit feeding of closure sheet strip 132 downwardly and adjacent the drum assembly 128. Closure lids 26 are arranged in a stack in lid dispensing magazine assembly 134 mounted from top frame member 126. By means as will be hereinafter described in detail, the hexagonally faced drum assembly 128 is indexed in a clockwise direction, as viewed in FIG. 5 and FIG. 7, whereby the lowermost lid 26 in the lid stack is received on one of the hexagonal faces of the drum assembly 128 and is held thereon by vacuum.

Subsequently, the drum assembly 128 is indexed a second time to rotate the hexagonal face and lid into contact with the closure sheet strip 132 which is held against the hexagonal face and lid by vacuum. Then, a third indexed rotation brings the combination of lid and closure sheet strip to a position wherein the sheet is severed from the bulk roll by cutter 328 (FIG. 11) to leave a square-shaped closure sheet 24 against the lid. The drum assembly 128 is subsequently indexed a fourth time again to bring the closure sheet above, and into alignment with, a receptacle 22 in conveyor 116. The square closure sheet 24 and lid 26 are forced down upon the opening of the receptacle 22 and a closure type engagement is formed therebetween. The filled and lidded receptacle, with the corners of the square closure sheet projecting from the periphery of the lid, then is moved forward by conveyor 116 for subsequent processing (FIG. 5) including heat-sealing the closure sheet to the interior of the rim of the container, the lid-sealing apparatus 64, and securing and heat-sealing, the projecting corners of the closure sheet to the exterior surface of the container in the tab-sealing machine 66. These subsequent processing steps will be described in detail hereinafter, but are here briefly summarized as follows: In the lid-sealing apparatus 64, the top of the container is brought into contact with a heated flanged disc which seals the closure sheet 24 to the receptacle rim and also guides the projecting closure sheet corners downward alongside the container sidewall. Next, in the tab-sealing apparatus 66, the tabs are heated to melt the wax coating and are subsequently cooled and pressed against the sidewall of the container to form a heat-sealed affixture.

With the above simplified description of the apparatus and method of operation in mind, a detailed description of the elements of the method and apparatus of the present invention will now be presented.

Figure 8:
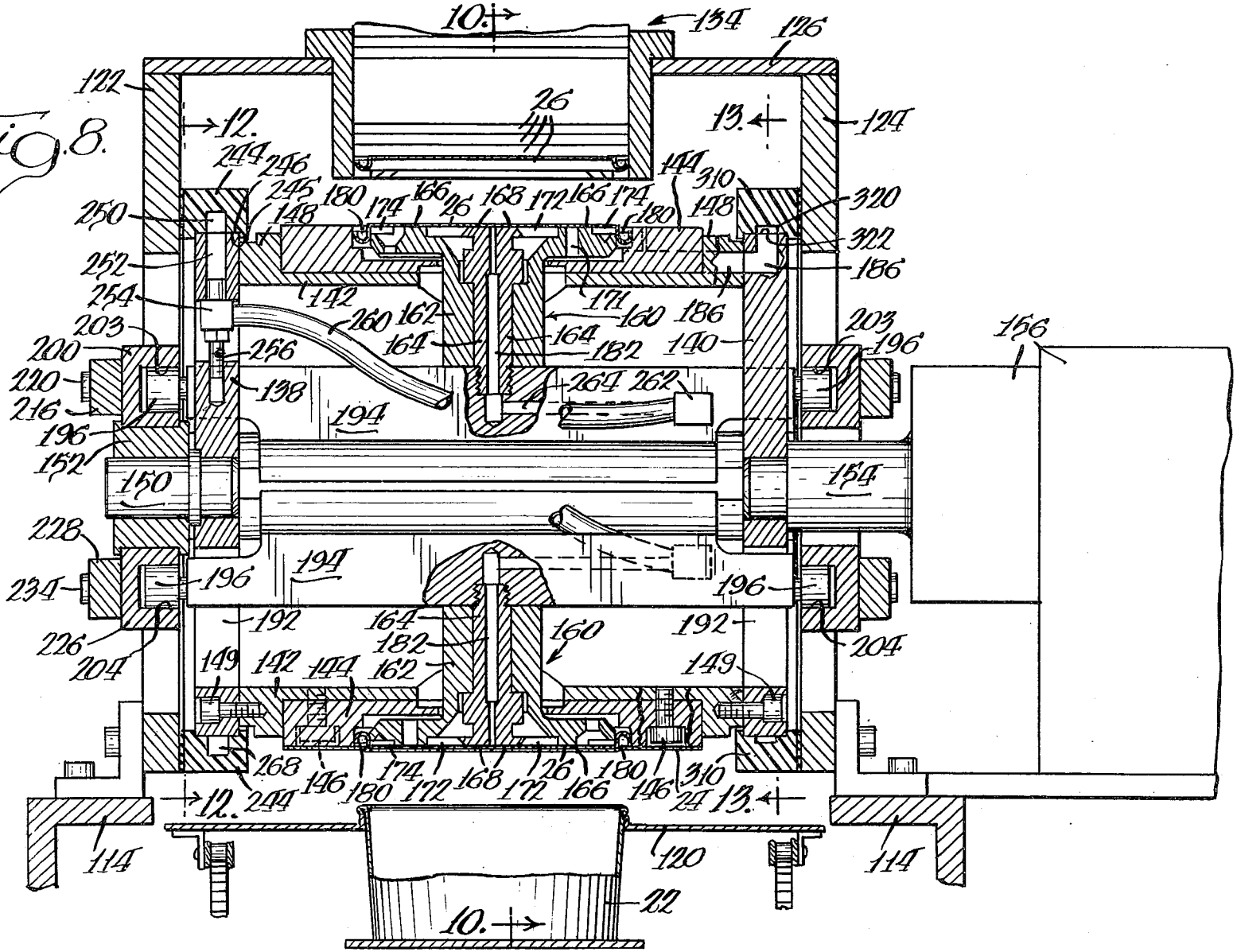
FIG. 8 is a cross-section view of the apparatus taken generally along plane 8—8 of FIG. 7 and showing the lid pick-up members in the retracted position.
Figure 9:
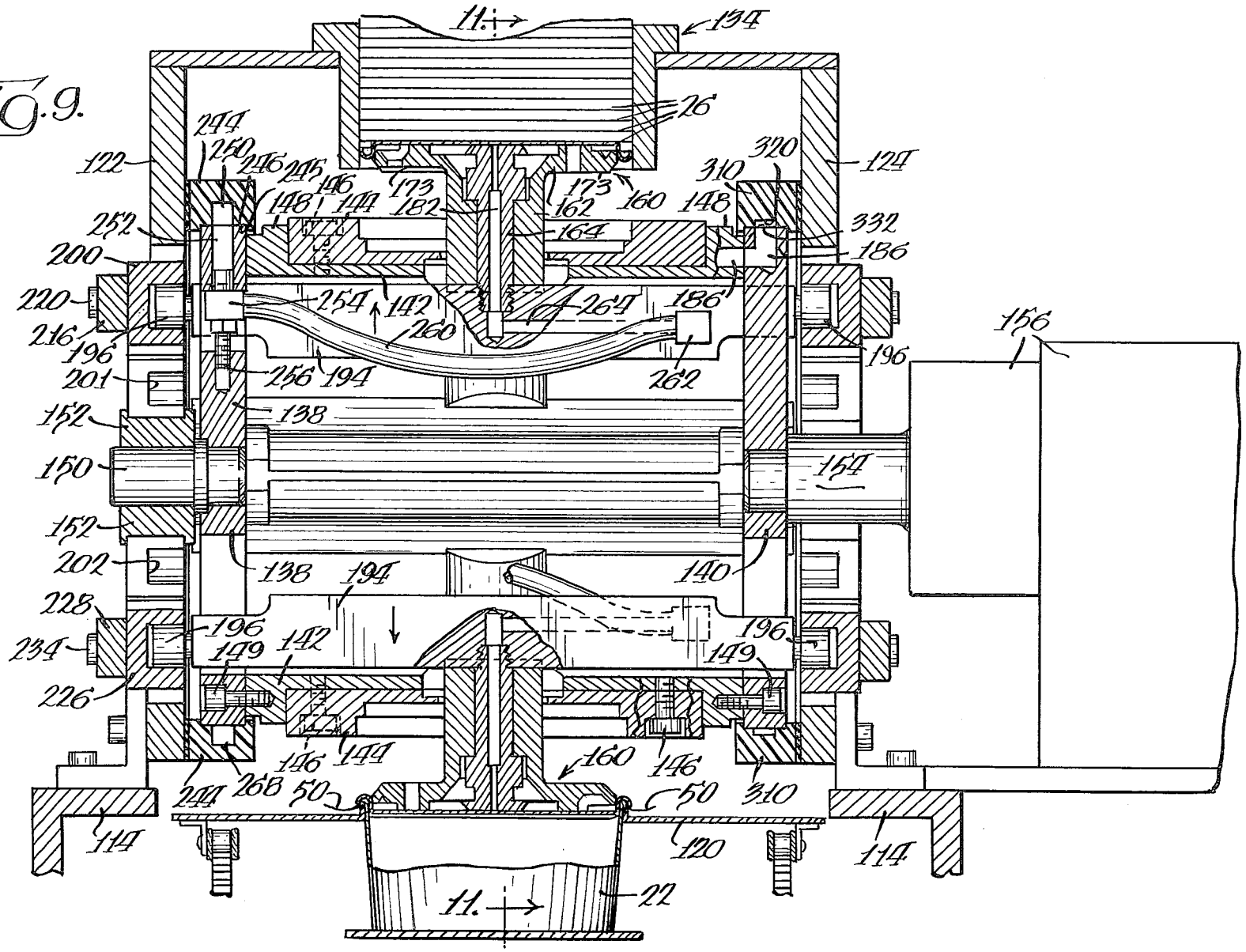
FIG. 9 is a cross-section view like FIG. 8, but showing the lid pick-up members in the extended position.
Figure 10:
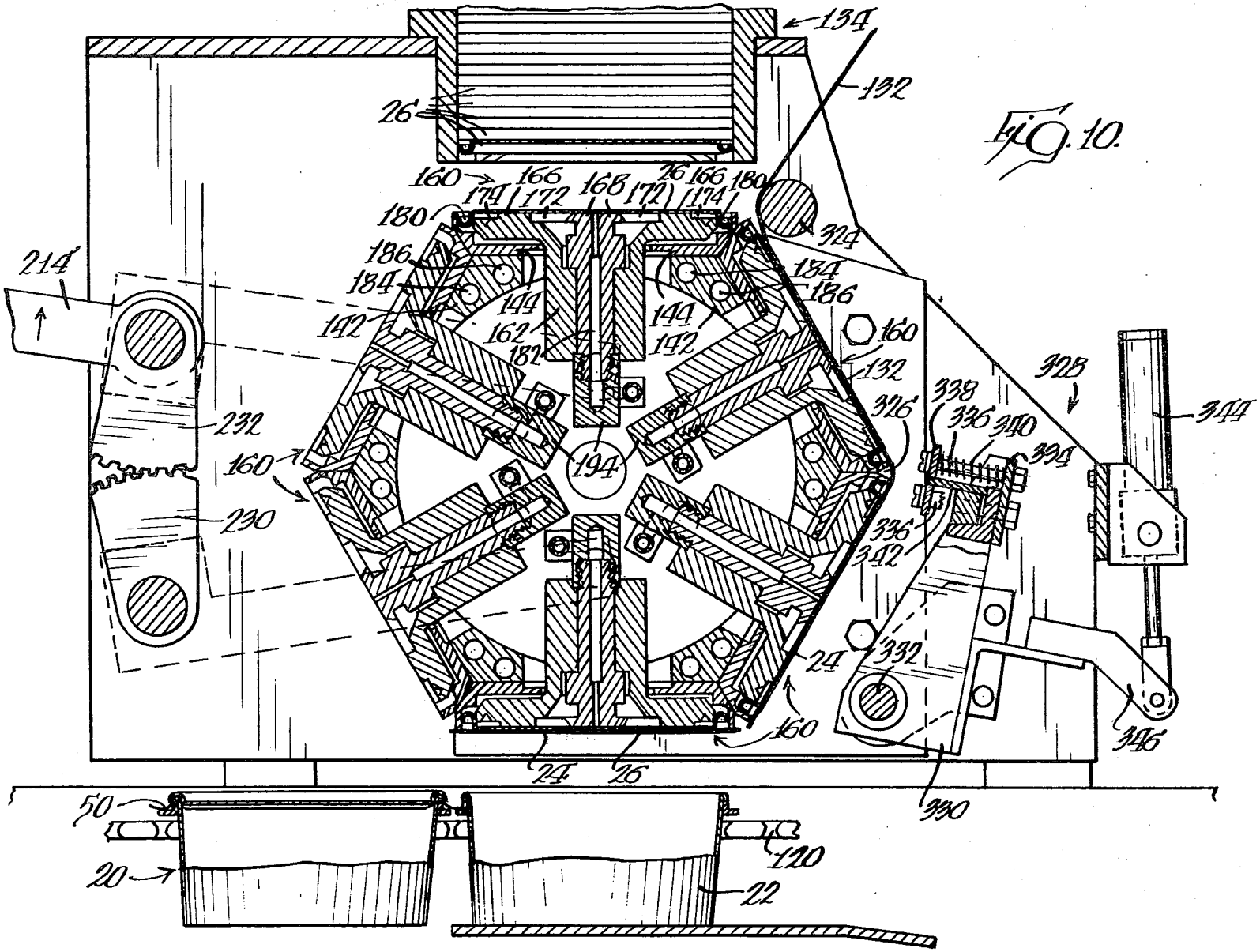
FIG. 10 is a fragmentary sectional view taken generally along plane 10—10 of FIG. 8.

The drum assembly 128 is comprised of three main elements: the drum front end plate 138, the drum back end plate 140, and a drum 142. As best illustrated in FIGS. 9 and 10, the drum 142 is an essentially round cylindrical tube, mounted horizontally, and in the exterior surface of which is machined, or otherwise suitably formed, hexagonal flat surfaces for receiving closure sheet carrier plates 144. One closure sheet carrier plate 144 is secured to each hexagonal flat of drum 142 by means of countersunk machine screws 146 (FIGS. 8 and 9). As also illustrated in FIGS. 8 and 9, a portion of the drum's exterior surface 148, on each end between (1) the sheet carrier plates 144, and (2) the drum front end plate 138 or drum back end plate 140, is cylindrical. The front end plate 138 and the back end plate 140 are secured to the ends of drum 142 with bolts 149 (FIGS. 8 and 9). The drum has no internal shaft and is mounted for rotation on each end by attachment to the front end plate 138 and back end plate 140. In the front, shaft 150 is keyed to front end plate 138 and journalled within bearing plate 152 (FIGS. 8 and 9), supported in frame member 122. In the back, drive shaft 154 is keyed to back end plate 140 and drivably connected to a suitable intermittent motion drive assembly 156, such as a Geneva gear drive.

A lid carrier plate 160 is provided in each sheet carrier plate 144 for initially receiving a lid 26 from dispensing mechanism 134 and subsequently transferring the lid and an associated length of closure sheet to the open top of a filled receptacle. There are six identical lid carrier plates 160, each being separately received within a closure sheet carrier plate 144, as shown in the cross-section view of FIG. 10. One such lid carrier plate, and its related structures, will be described, and it is to be understood that the other lid carrier plates and related structures are identical in both form and function. Lid dispensing assembly 134 is mounted in, and projects through, top frame 126 above the drum assembly 128 and is suitably located whereby a lid carrier plate 160 may be aligned with a lid 26 held at the bottom of the lid dispensing assembly. As can be seen by reference to FIG. 8 and FIG. 9, the lid carrier plate 160 is movable between a seated position on closure sheet carrier plate 144 and an extended position displaced from the associated closure sheet carrier plate 144. As illustrated in FIG. 9, in the extended position, lid carrier plate 160 can be brought into contact with lowermost lid 26 in the lid dispensing assembly 134 and can, after 180° of rotation of the drum assembly 128, be extended again, to bring the lid and associated closure sheet into contact with the rim of a receptacle 22.

Figure 14:
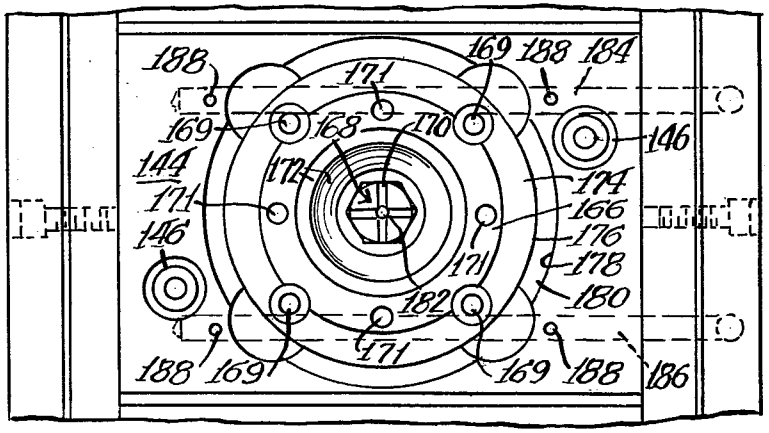
FIG. 14 is a plan view of a hexagonal face of the drum assembly of the apparatus of this invention taken generally along plane 14—14 of FIG. 13.

As best illustrated in the cross-sectional view in FIG. 8 and the plan view of FIG. 14, the lid carrier plate comprises an outer portion 162 which surrounds an interior post member 164 and presents two exterior annular flat faces: one being a recessed outer peripheral face 174 and the other being an inner face 166 raised above, and circumferentially adjacent to, the recessed outer peripheral face 174. The interior post member 164 presents a hexagonal flat face 168 spaced inwardly from inner face 166 and presenting cross-shaped vacuum channels 170. The vacuum channels 170 communicate with an annular vacuum channel 172 between, and defined by, inner hexagonal face 168 and inner annular face 166. Circumferentially spaced apertures 171 are provided in the inner face 166 and circumferentially spaced apertures 169 are provided at the common circumference between the inner face 166 and the recessed outer peripheral face 174, both apertures 169 and 171 communicating to the underside 173 of the carrier plate outer portion 162, as shown in FIG. 9, for relieving vacuum when the vacuum source is disconnected as the lid is deposited on an open top receptacle as will hereinafter be described. Through vacuum channels 170 and 172, a lid 26 can be held against the lid carrier plate 160 as shown in FIG. 8. In FIG. 14, the outer peripheral edge of lid carrier plate 160 is designated by reference numeral 176 and the surrounding inner edge of the closure sheet carrier plate 144 is designated by reference numeral 178. The annular space between the lid carrier plate outer edge 176 and the sheet carrier plate inner edge 178 is designated by reference numeral 180.

As illustrated in FIG. 8 and FIG. 14, the rim of lid 26 resides in the annular clearance space 180 between the outer edge of lid carrier plate 160 and the inner edge of the closure sheet carrier plate 144.

Interior post member 164 has an axially extending main vacuum passage 182 (FIG. 8 and FIG. 14) that communicates with intersecting cross-shaped vacuum channels 170 and the interior post member's annular face 66 to thereby supply vacuum to annular vacuum channel 172. Vacuum applied through these channels holds lid 26 against lid carrier plate 160 throughout the operation of removing the lid from the lid dispensing assembly 134 and subsequently applying the lid to the top of a container 20 as shown in FIG. 9.

The closure sheet strip 132 is also held against the closure sheet carrier plate 144 by vacuum. Vacuum passages 184 and 186 (FIGS. 13 and 14) extend through the interior of the wall of drum 142 below each closure sheet carrier plate 144. Apertures 188 in the closure sheet carrier plate 144 connect with the vacuum passages 184 and 186 for applying vacuum to the closure sheet strip 132 at the surface of the closure sheet carrier plate 144. Closure sheet carrier plate 144 is secured to the hexagonal flat portion of drum 142 by means of countersunk bolts 146 as previously described and as illustrated in FIG. 14. The closure carrier plate 144 and the lid carrier plate 160 are both removable from the drum assembly and replaceable with different size plates for accommodating different size lids 26.

Figure 11:
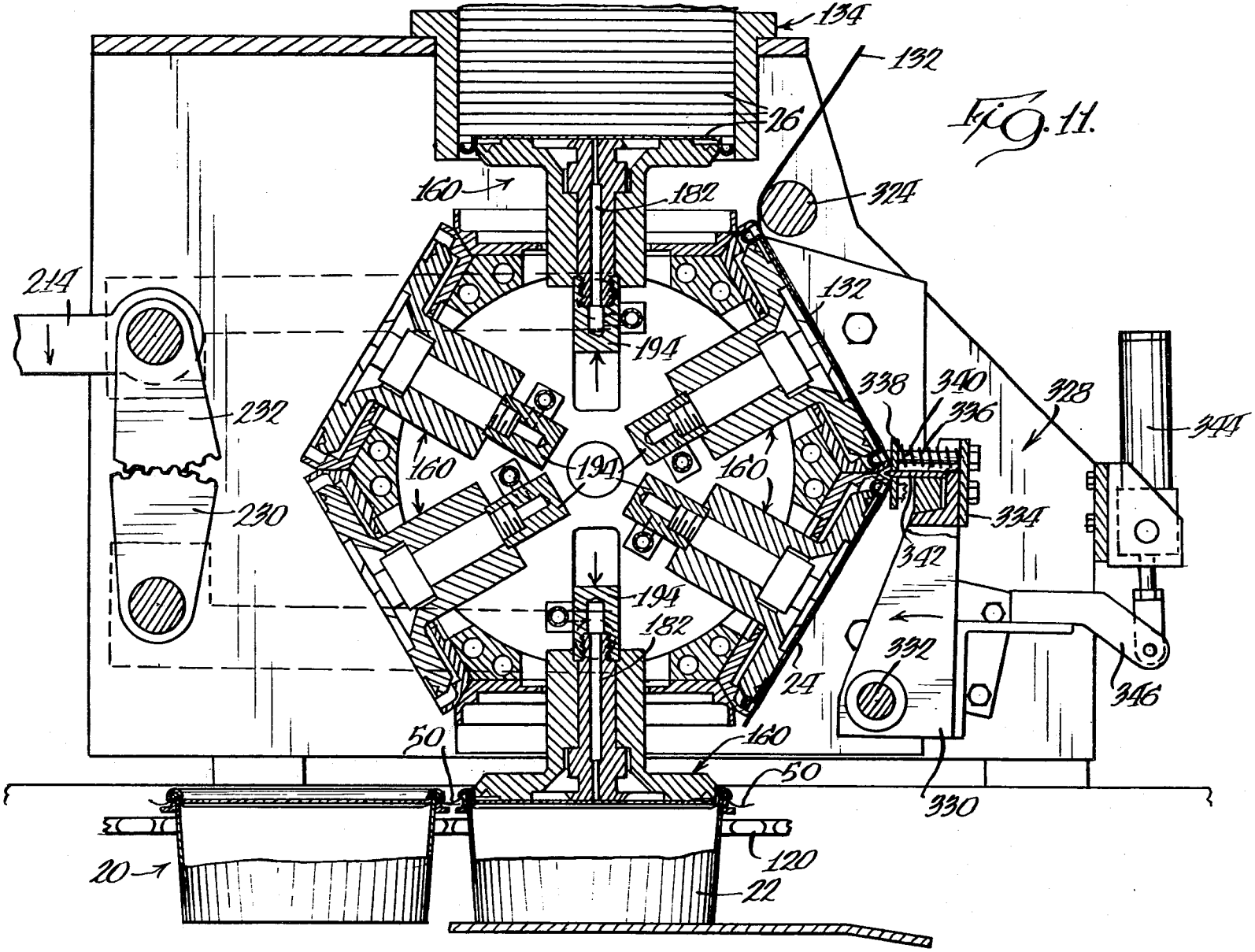
FIG. 11 is a fragmentary sectional view taken generally along plane 11—11 of FIG. 9.

The mechanism for moving the lid carrier plate 160 reciprocally in the vertical direction below the lid dispensing assembly 134 and subsequently above the container 20 will now be described. A plurality (one for each carrier plate 160) of radially disposed aligned slots 192 (FIGS. 8, 12 and 13) are provided in the front end plate 138 and the back end plate 140. Disposed within the drum 142 and slidably supported in each slot 192 are slide bars 194. As illustrated in FIG. 8, each slide bar 194 is secured, at its middle portion, to lid carrier plate 160 by means of an externally threaded end of post 164 engaging a threaded opening in slide bar 194. Each slide bar 194 is reciprocated in a slot 192 to move the attached lid carrier plate 160 from its seated position on closure sheet carrier plate 144 to an outwardly extending position for engagement with a lid 26 in the lid dispensing assembly 134 or for placing a lid upon a container 20 as illustrated in FIGS. 9 and 11. As drum assembly 128 is rotatably indexed, the side bars are retained in the inward end of slots 192 as will now be described.

Figure 7:
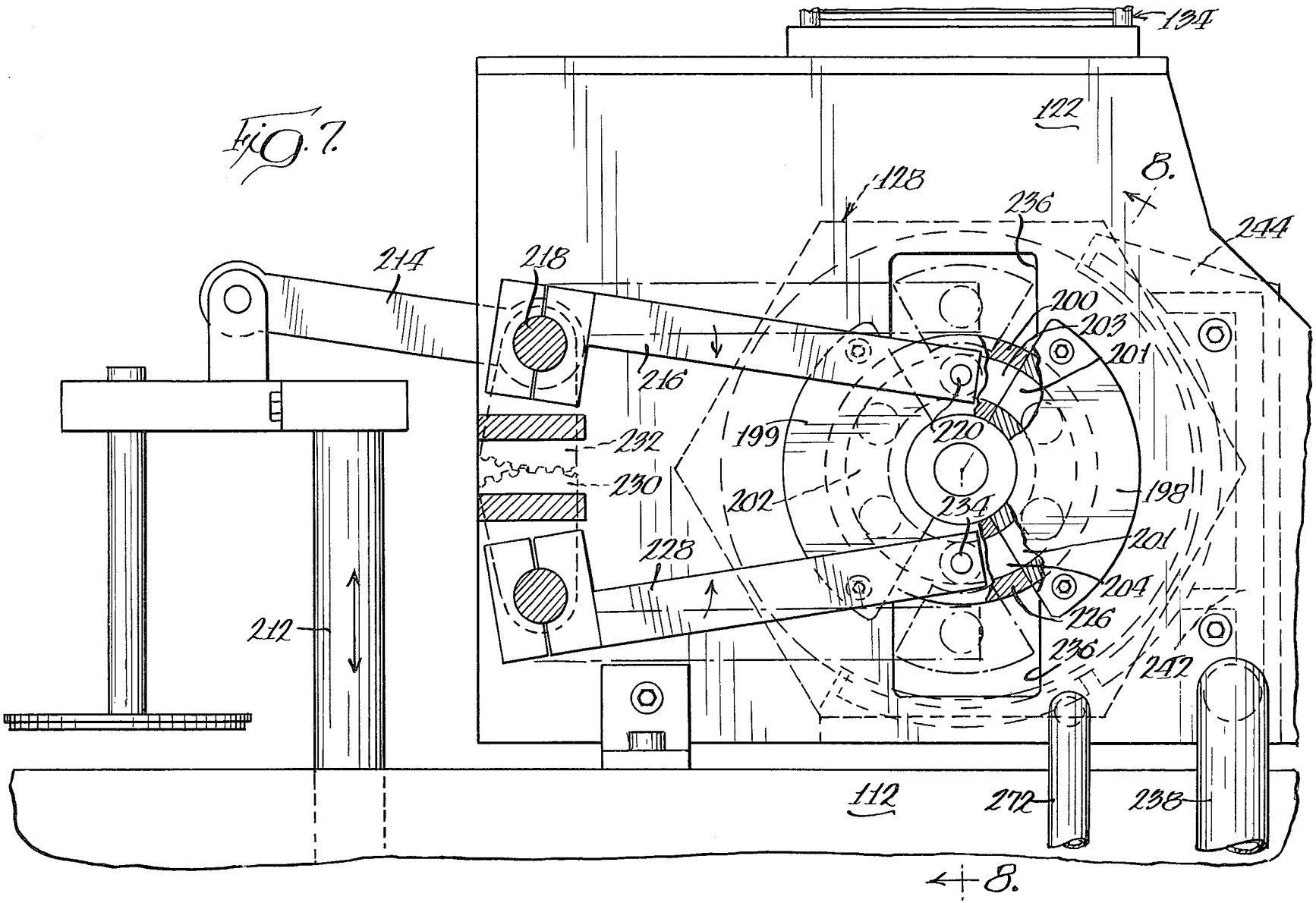
FIG. 7 is a fragmentary elevation view of the apparatus shown in FIGS. 5 and 6.

On each end of the slide bar 194 is a roller 196. As illustrated in FIGS. 5, 7 and 8, each roller 196 is adapted to project from the end of slide bar 194 into a circular guide channel formed by two opposed 120° truncated sector-shaped members 198 and 199, having fixed guideways 201 and 202 respectively, in combination with two opposed 60° truncated sector-shaped movable upper and lower wedge members 200 and 226, respectively, having guideways 203 and 204, respectively. The members 198 and 199 are mounted on side frame 122 on the front face of the apparatus. Similar members are provided in side frame 124 in the back of the apparatus. The detailed structure on the back of the machine (not shown) is identical with that on the front and will not be described. Wedge members 200 and 226 are each disposed in a wedge, or pie-shaped, opening between the members 198 and 199 at the top and the bottom as shown in FIG. 7 to self-aligningly seat therein and to allow for reciprocating movement therefrom. In upper wedge member 200, guideway 203 presents guideway surfaces having radii equal to the radii of the corresponding fixed guideways 201 and 202. Wedge member 200 is movable from (1) an inner position wherein the wedge guideway 203 is in alignment with the fixed guideways 201 and 202 to (2) an outer position (shown dashed in FIG. 7). Movement of wedge member 200 between the inner and outer positions is effected by reciprocating member 212 acting upon linkage member 214 to rotate drive member 216 about a horizontal shaft 218. Drive member 216 is pivotally connected to wedge member 200 by shaft 220.

Similarly, lower wedge member 226 is likewise movable from an inner to an outer position by drive member 228. Drive member 228 is rotated by the action of paired sector gears 230 and 232. Sector gear 232 is secured to linkage arm 214 for rotation about shaft 218. Wedge member 226 is pivotally mounted to drive member 228 about shaft 234. It is seen that wedge members 200 and 226 thus simultaneously and together move between an inner position and an outer position as shown in dashed line in FIG. 7. Cut-out edges 236 in the front side frame 122 provide appropriate accommodation of the wedge members 200 and 226 in their outer positions.

The above-described construction permits rapid and positive indexing motion for each lid carrier plate 160 in the upper lid receiving position and in the lower lid placement position. At the start of an indexing cycle, before any drum movement occurs, the wedge members 200 and 226 are seated in their respective inner positions wherein their guideways 203 and 204 are aligned with the fixed guideways 201 and 202. Slide bar rollers 196 are received in the fixed guideways 201 and 202 and wedge guideways 203 and 204 in an equally spaced array. By appropriate conventional indexing control means, drive means 156 acts through shaft 154 to rotate drum assembly 128 one-sixth of a revolution. During this one-sixth revolution, the walls of slots 192 in the drum front end plate 138 and in the drum back end plate 140 urge slide bars 194 and their respective rollers 196 along the circular guide channel defined by the fixed guideways 201 and 202 and the aligned wedge guideways 203 and 204. After termination of the indexed rotation, a roller 196 of one slide bar 194 has been positioned in the wedge guideway 203 of upper wedge 200 and another roller 196 of another slide bar 194 has been positioned in the wedge guideway 204 of lower wedge 226. By suitable conventional control means 237, such as a Geneva gear drive, reciprocating member 212 is driven downwardly to effect, through the above-described linkage members, outward movement of wedge members 200 and 226. As shown in the cross-section views of FIGS. 8 and 10, when wedge member 200 and 226 are in the inner position, then slide bars 194 are at their most radially inward position to cause lid carrier plates 160 to be seated against the closure sheet carrier plates 144. When the wedge members 200 and 226 are in their radially outward position as shown in FIGS. 9 and 11, then two slide bars 194 are also in their radially outward position. In this outward position, the lid carrier plate 160 at the top of the drum assembly 128 is in the extended position displaced from the closure sheet carrier plate 144 and is thus brought into contact with the lid 26 (on the bottom of the stack of lids 26 in the lid dispensing assembly 134) to receive and hold the lid. When the associated slide bar 194 is subsequently moved by wedge member 200 to the most radially inward position, the lid carrier plate 160 is returned to the seated position on the closure sheet carrier plate 144 with the lid 26. The drum assembly 128 is subsequently rotated to receive and sever a closure sheet 24 superposed upon lid 26 and sheet carrier plate 144, as will be explained in detail later. A subsequent rotation of the drum assembly presents the lid 26 and superposed closure sheet 24 at the bottom of the drum assembly above an open top receptacle 22. Then, movement of the slide bar 194 to the radially outward position moves lid carrier plate 160 to the extended position displaced from closure sheet carrier plate 144 to carry the lid 26 and associated superposed closure sheet 24 into proper placement on the open top of a receptacle 22 below the drum assembly.

Figure 6:
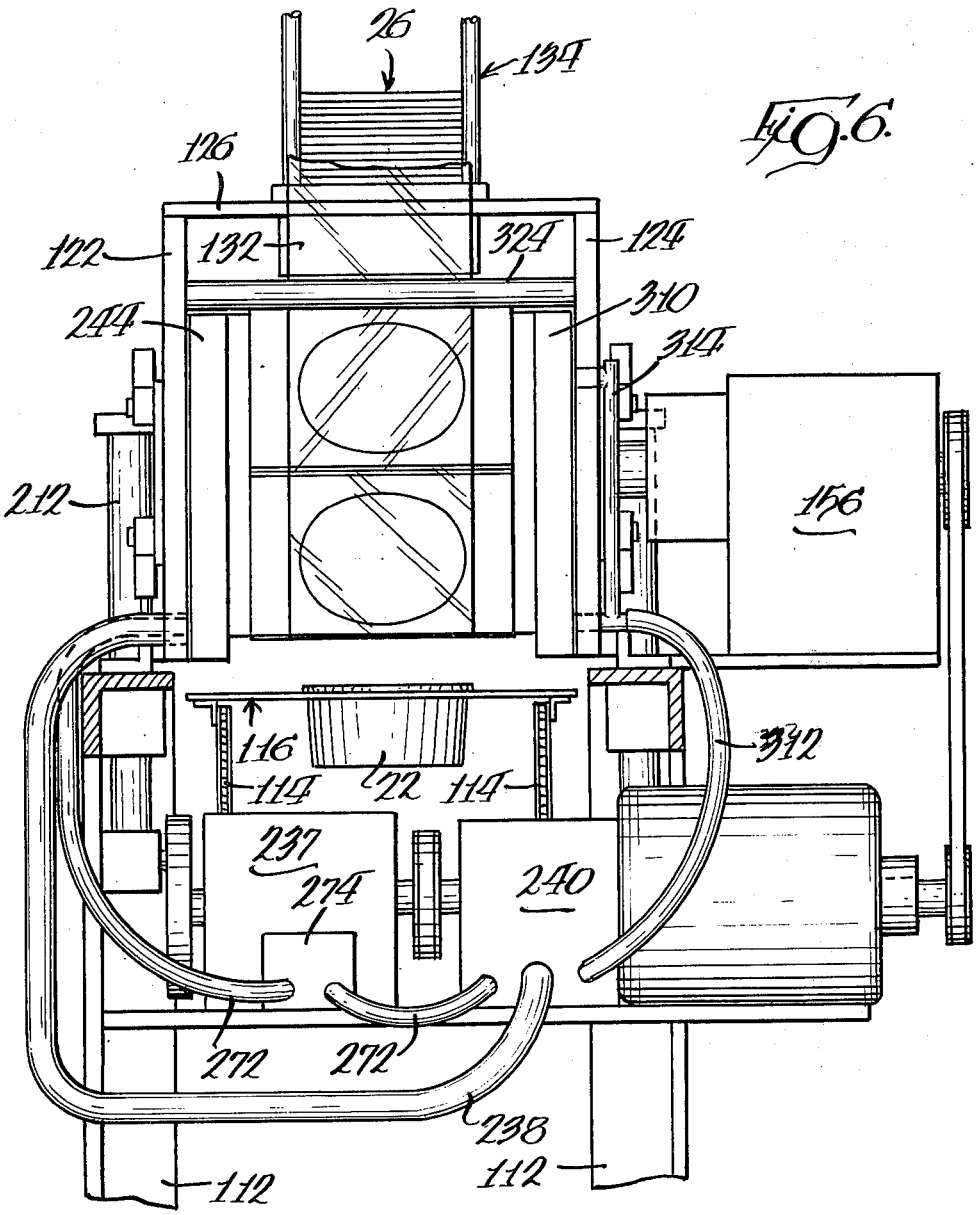
FIG. 6 is a cross-section view of the apparatus of this invention looking from the right-hand side of FIG. 5.
Figure 12:
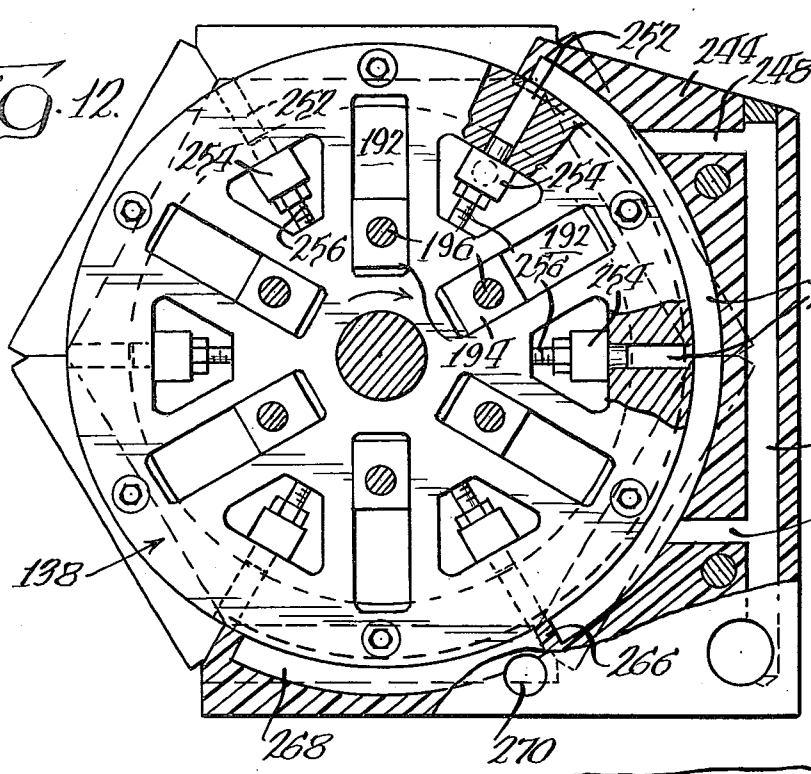
FIG. 12 is a fragmentary sectional view taken generally along plane 12—12 of FIG. 8.

Vacuum supply passages are provided within the apparatus to supply the lid carrier plates 160 with vacuum. As illustrated in FIGS. 5 and 6, a constant vacuum source hose 238 connects a vacuum pump 240 to front side frame 122. As illustrated in FIG. 7. vacuum source hose 238 communicates through side frame 122 with a passage 242 (shown dashed) within a vacuum chamber assembly 244 (shown in cross-section in FIG. 12). Vacuum chamber assembly 244 is parallel to, and adjacent, the rear surface of front side frame 122 and is circumferentially peripheral to about one-half of the outer circumference of drum front end plate 138. Vacuum passage branches 246 and 248 communicate to a circular arc vacuum supply channel 250. As illustrated in the cross-section view shown in FIG. 8, the cross-section of channel 250 in vacuum chamber assembly 244 is square. The inner, circumferentially peripheral walls 245 of the vacuum chamber assembly 244 sealingly abut and engage the outer circumferentially peripheral walls 246 of the drum front end plate 138 to prevent leakage into vacuum supply channel 250. Vacuum passages 252 are illustrated in FIGS. 8 and 12 at six equally spaced intervals about the periphery of the drum front end plate 138. These passages 252 communicate with vacuum supply channel 250 as the portion of the drum front end plate 138, which contains one of the six passages 252, is rotated adjacent to the vacuum chamber assembly 244 and thus into alignment with the vacuum supply channel 250. A right angle hose fitting 254 is secured over the opening of each passage 252 at the end of each passage 252 opposite the vacuum supply channel 250 as shown in FIGS. 8 and 12. Right angle hose fitting 254 is supported in such engagement with passage 252 by screw 256. Hose 260 connects angle fitting 254 with angle fitting 262 on slide bar 194. Within slide bar 194 is a vacuum passage 264 (FIGS. 8 and 9) which provides communication between angle fitting 262 and the previously described lid carrier plate vacuum passage 182. Hose 260 is disposed with slack between right angle hose fittings 254 and 262 to provide appropriate flexibility for accommodating the vertically reciprocating motion of slide bar 194.

With reference to FIG. 12, it is seen that channel 250 extends in an arc of about 120° beginning from one end located at about 30° clockwise from a vertical line passing through the center of the end plate 138 and ending at wall 266 about 30° counterclockwise from a vertical line passing through the center of the end plate 138. Note that each passage 252 associated with a specific slide bar 194 and connected lid carrier plate 160 is displaced about 30° clockwise (as viewed in FIG. 12) from that specific slide bar 194 and connected lid carrier plate 160. Thus, vacuum is supplied via channel 250 to the lid carrier plate 160 from the top vertical position in the rotating drum assembly, and for a portion of circumferential travel of about 120°, where the vacuum supply channel 250 is terminated by wall 266 before the lid carrier plate 160 has reached the bottommost orientation on the drum assembly 128. On the other side of wall 266 is provided another vacuum supply channel 268, identical in end cross-section to channel 250, which communicates with aperture 270 in the vacuum chamber assembly 244 and in the front side frame 12 to connect with on-off vacuum hose 272 shown in FIGS. 5, 6 and 7. On-off hose 272 is connected to vacuum pump 240 through on-off valve 247. Channel 268 extends in an arc around the drum end plate 138 for about 60° starting on one end at wall 266 about 30° counterclockwise from a vertical line passing through the center of end plate 138 and ending at the other end at about 30° clockwise from vertical line passing through the center of end plate 138. This allows vacuum to be drawn on lid carrier 160 through the appropriate passage 252 as it rotates with drum assembly 128 from wall 266 to the bottom vertical orientation on the drum assembly 128. By appropriate conventional control means, on-off valve 247 can be actuated to provide vacuum through hose 272 to the vacuum supply channel 268 and hence to hold a lid to the lid carrier plate 160 so long as the lid carrier plate 160 is being moved to the bottom vertical position and so long as the lid carrier plate 160 is being extended in that bottom vertical position to engage the open top receptacle 22. The vacuum can be terminated by valve 274 when lid carrier plate 160 has reached the maximum extent of its radially outward travel and has forced the closure sheet off of the sheet carrier plate 144 and engaged the receptacle 22 for securing the lid and closure sheet thereto. At this point, when the vacuum is terminated by valve 274, the lid, being no longer held to the lid carrier plate 160 by the vacuum, remains engaged with the rim of receptacle 22 as the lid carrier plate 160 is then retracted from the receptacle 22 and returned to its seated position on closure sheet carrier plate 144. At the initiation of the next indexing sequence of drum assembly 128, valve 274 is actuated to again permit vacuum to be drawn through hose 272 on vacuum supply channel 268 for furnishing vacuum to the next lid carrier plate 160 being rotated into position as the vacuum passage 252 associated with that next lid carrier plate 160 is rotated past wall 266 into communication with channel 268.

The use of two separately controlled vacuum channels, 250 and 268, permits vacuum to be continuously applied to the channel 250 supplying an upper lid carrier plate 160 for receiving a lid while simultaneously permitting vacuum to be terminated in the channel 268 to the lower lid carrier when the lid and closure sheet have been engaged with a receptacle 22.

Figure 13:
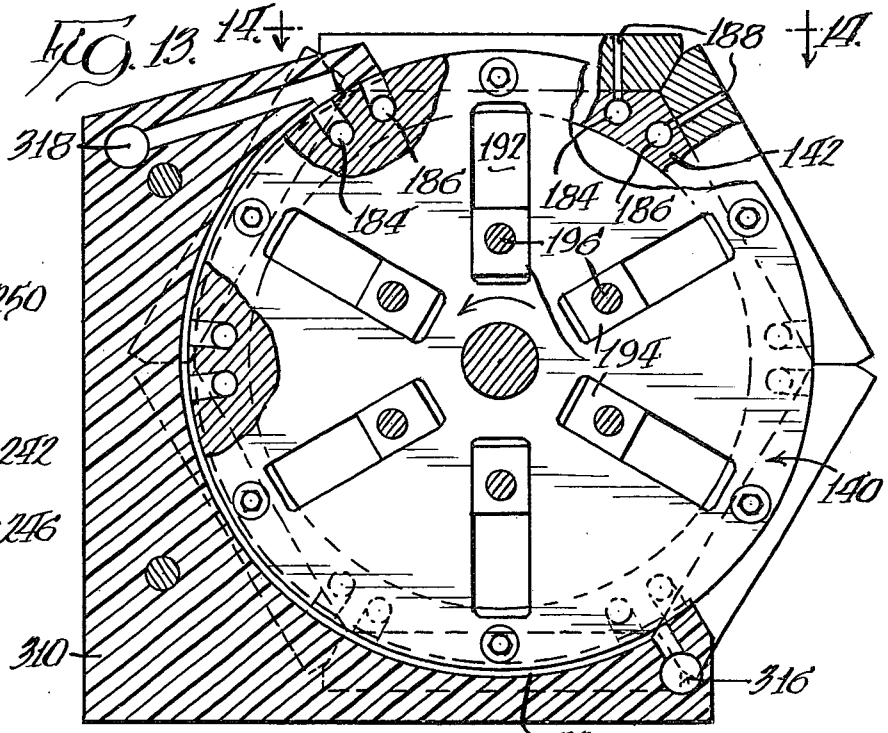
FIG. 13 is a sectional view taken generally along plane 13—13 of FIG. 8.

As previously mentioned, the closure sheet strip 132 is held against a lid and against the closure sheet carrier plate 144 by a vacuum. In general, vacuum is introduced to the closure sheet carrier plate 144 through a vacuum passage system in vacuum chamber assembly 310 which is mounted parallel to, and adjacent with, the inner back surface of side frame 124 as shown in cross-section in FIGS. 8 and 13. As illustrated in FIG. 6, vacuum pump 240 is connected through hose 312 to pipe 314 which passes through the rear side frame 124 to vacuum chamber assembly 310. Pipe 314 is connected to vacuum chamber assembly 310 through apertures 316 and 318 as illustrated in FIG. 13. These apertures communicate with a circumferential vacuum channel 320 in vacuum chamber assembly 310 which is open on one side to communicate with the peripheral surface 322 of the drum back end plate 140 as is best illustrated in FIGS. 8 and 9. Vacuum passage 322 communicates to the interior portion of the wall of drum 142 on each side of the hexagonal flat portion through the previously described vacuum apertures of passages 184 and 186 as shown in an end cross-section view in FIG. 13 and in a side cross-section view in FIG. 8 and FIG. 9. These apertures communicate with apertures 188 (FIGS. 13 and 14) in the surface of the closure sheet carrier plate 144 for providing vacuum for holding the closure sheet strip 132 against the carrier plate 144. As illustrated in FIG. 13, vacuum can be continuously provided via channel 320 and passages 184 and 186 to each closure sheet carrier plate 144 as it rotates with the hexagonal drum assembly 128 from an upper position to the lowest position. No vacuum on-off valve is provided in the vacuum passage circuitry for the closure sheet strip vacuum hold down apertures 188 since such an additional complication is not required as will be hereinafter explained.

The closure sheet strip 132 is guided into contact with the closure sheet carrier plate 144 by turn bar 324 as illustrated in FIGS. 5, 6 and 10. Vacuum drawn through apertures 188 (shown in FIG. 14) cause closure sheet strip 132 to be pressed, by ambient atmospheric air pressure, against the lid 26 in place on the lid carrier plate 160 and against the surrounding portion of closure sheet carrier plate 144.

After the strip 132 is held against the sheet carrier plate 144 in the drum assembly 128 by vacuum, a square sheet 24 is formed by severing the strip 132. After each one-sixth rotation of the drum assembly 128, the corner formed by two adjacent closure sheet carrier plates 144 is presented at a midpoint position between the drum assemblies upper and lower faces and adjacent a closure sheet strip cutter 328 (FIG. 10). During the rotation of the drum assembly 128, closure sheet strip cutter 328 is in a retracted clearance position as shown in FIG. 10. Closure sheet strip cutter 328 comprises a vertical member 330 pivotally mounted about shaft 332 for rotation in a clockwise direction as viewed in FIG. 10. Mounted on vertical member 330 is a back plate 334 which extends, on each end, beyond the length of the drum assembly 128. Blade support screws 336 are mounted near each end of back plate 334 and support a front plate 338 which is parallel to back plate 334 and is of the same length. Front plate 338 is biased forward and away from back plate 334 by springs 340 which are mounted around the screws 336. Blade 342 is mounted on, and perpendicular to, back plate 334. Front plate 338 has a slot through which a blade 342 can project. In the retracted position shown in FIG. 10, front plate 338 is biased forward against the heads of screws 336 by springs 340 so that it extends to the cutting edge of blade 342. The closure sheet strip cutter 328 is moved from the retracted position as shown in FIG. 10 to a sheet cutting position as shown in FIG. 11 by conventional actuator means 344 acting through linkage member 346. Actuator 344 may be a conventional pneumatically operated cylinder. In the cutting position, front plate 338 impinges upon closure sheet strip 132 and presses it against the corners of the closure sheet carrier plates 144. Front plate 338 is forced backward along screws 336 and compresses springs 340, thus exposing blade 342 through the slot in the front plate 338 so that blade 338 severs the closure sheet strip 132 to form a severed length of sheet 24. By appropriate conventional control means, the closure sheet strip cutter 328 is returned to the retracted position before drum assembly 128 is indexed for the next 60° rotation.

After the closure sheet strip 132 is severed by closure sheet strip cutter 328, the portion of the closure sheet strip which is held by vacuum to the closure sheet carrier plate 144 and is below the cutter blade 342, is then in a quadrilateral or preferably square-shaped sheet 24. The square-shaped closure sheet 24 completely covers the lid 26 which is held on the lid carrier plate 160. Both the lid 26 and the closure sheet 24, being held by vacuum to the sheet plate 144 on the drum assembly 128, are then rotated when the drum assembly is rotated another 60° to bring both the lid 26 and the closure sheet 24 into alignment with a receptacle 22 which has been indexed below the drum assembly by conveyor 116 (FIG. 10). Actuation of the lid carrier plate 160 to move it to its fully extended position, as previously described, forces the closure sheet 24 off of the closure sheet carrier plate 144 with the lid 26 being disposed between the lid carrier plate 160 and the closure sheet 24 (FIGS. 9 and 11). The vacuum aplied to the closure sheet carrier plate 144 is not shut-off or disconnected, and is not required to be so disconnected, since the lid carrier plate 160 is driven with enough force to overcome the vacuum hold down force on the closure sheet 24. As described previously, when the lid carrier plate 160 has reached the maximum extent of its downward travel, the vacuum source to the vacuum passages within the lid carrier plate 160 are cut-off by valve 274, leaving the lid 26 and square closure sheet 24 engaged with the open top of the receptacle 22. As the lid carrier plate 160 is next raised from the receptacle 22, the lid and closure sheet 24 remain engaged with the mouth of the receptacle 22 leaving the corners 50 of the square closure sheet 24 projecting from the periphery of the container as shown in FIG. 9 and FIG. 11.

The container 20, with the corners 50 of the square closure sheet projecting from the periphery of the lid, then is moved forward by conveyor 116 for subsequent processing which includes heat-sealing the closure sheet to the interior of the rim of the container and securing, or heat-sealing, the projecting corners of the closure sheet to the exterior surface of the container.

The closure sheet is sealed or secured to the rim of the lidded receptacle 22 (not container 20) and the tabs are secured to the side of the container by apparatus as disclosed in the previously mentioned copending application entitled "Method and Apparatus for Sealing Tamper-Indicating Tabs to a Container Sidewall."

In FIG. 5, the apparatus of the present invention is illustrated as forming a continuous processing chain. First in the chain is the container assembly apparatus 100 which has been described above and which assembles a lid 26 and closure sheet 24 together on an open top receptacle 22. Forming part of a continuous process path, and located downstream of container assembly apparatus 100, is lid sealing station 64. The tab securing, or tab sealing station 66 is located downstream of, and adjacent to, lid sealing station 64. Though the lid sealing station 64 and tab sealing station 66, and operation thereof, are described in the previously mentioned copending application, they are here described in combination with the container assembly apparatus 100, since they cooperate in combination to form completed containers with the desired tamper-indicating feature.

Before describing the details of lid sealing station 64 and tab sealing station 66, a short summary will be given. After the lid 26 and closure sheet 24 are placed on the receptacle 22 to form a container 20 by the container assembly apparatus 100, the process of securing tamper-indicating heat-securable closure sheet corners or tabs 50 to the sidewall 28 of the container 20 (FIGS. 1, 2 and 3) is initiated by moving the container upright along a process path and deflecting the projecting corners 50 of the flexible tamper-indicating sheet 24 to urge them downwardly alongside the sidewall of the container. In the preferred method, in lid sealing station 64, the projecting corners or tabs 50 are simultaneously heated as they are downwardly deflected to create a heat-set that prevents the corners or tabs 50 from springing upwardly again before the next step can be performed. The container 20 is then moved to the tab sealing station 66 where heat is applied to the tabs as the container is rotated so that all of the tabs are heated. As the container is thus rotated, the heated corners, or tabs 50 of the closure sheet 24 are pressed against the container 20 to secure them to the sidewall of the container.

The lid sealing station 64 which performs part of the above-described process includes a turret-type sealing machine having a plurality of non-rotating, annularly spaced apart and heated sealing discs and matching bottom container support ram posts which revolve about the central axis of the machine. A conveyor 70 is provided to receive the container 20 from the upstream container assembly apparatus 100 and feed them into the lid sealing station 64 as illustrated in FIG. 5. Suitable conventional transfer mechanisms (not shown) are employed to transfer a lidded receptacle 22 or container 20 from conveyor 116 of the assembly apparatus 100 to the conveyor 70 of the lid sealing station 64. An auger 71 is provided to feed containers 20 in timed relationship into the lid sealing station 64. Mounted for rotation above the conveyor 70 are suitable rotating in-feed and out-feed star-wheel apparatus 72 and 74. A suitable fixed guide 76 is provided for the purpose of guiding the container 20 onto the respective container ram support posts 78 which are vertically movable and which revolve about the vertical central axis of the machine during operation. It will be further understood that the conveyor 103 is driven in the direction indicated by the arrow in FIG. 5 by mechanisms (not illustrated) within a base frame 80, and that the speed may also be controlled in time relationship with the speed of the rotation of the in-feed and out-feed starwheels 72 and 74 for the purpose of moving the respective containers smoothly into and out of the machine. A container transport starwheel (not shown) is mounted for rotation about a vertical axis and has a plurality of annularly spaced apart container receiving grooves for positioning and carrying the capped containers 20 during the lid-sealing operation which is performed by the machine. The containers 20 are placed upon the vertically movable container support posts 78 which, while revolving with the machine, elevate the containers 20 respectively into engagement with an associated sealing disc 82 which moves concurrently about the machine with the container 20 in response to machine rotation. A depending peripheral flange 84 is provided on the lower periphery of the sealing disc. As a container 20 is elevated against the sealing disc 82, the flange 84, acting as a flexible sheet tab guide, pushes the projecting tabs 50 downwardly alongside the container 20. The sealing disc 82 is provided with a heating source which, when the container and lid bears against the disc 82, causes the wax-coated flexible closure sheet 24 to be sealed to the rim of the container 20. Further, during this operation, heat is conducted from the sealing disc 82 to the peripheral flange 84 which is in contact with the flexible closure sheet tabs 50. The tabs are heated and take on a heat-set orientation in a downwardly extending position adjacent the container sidewall. When the container 20 is lowered away from the sealing disc 82, the tabs 50 remain in the downwardly extending position. The container 20 exits from the left side of the lid-sealing apparatus 64 through the out-feed starwheel apparatus 74 and proceeds along conveyor 70 to the tab sealing station 66, wherein the tamper-indicating tabs 50 are secured to the container's sidewall.

In the tab sealing apparatus 66, a tab heating rail 86 is provided on one side of conveyor 70 and a horizontally mounted tab sealing belt 88 is provided on the other side of the conveyor 70 opposite the tab heating rail 86. Both the tab heating rail 86 and the tab sealing belt 88 are elevated from the surface of the conveyor 70 to a height adjacent the tabs 50 of the closure sheet 24 as they extend downwardly and alongside the container sidewall. In the preferred embodiment, a tab heating rail 86 is mounted on, and connected to, an electrical resistance heating rod (not shown) which conducts heat to the heating rail 86. The heating rail 86 presents a flat surface 87 parallel to the sidewall of the container 20 and bears against the sidewall of the container as the container is moved along the conveyor 70. On the opposite side of the conveyor 70, the tab sealing belt 88 is rotated faster than the conveyor 70 and engages the side of the container 20 to roll the container 20 along the tab heating rail 86 whereby each tab is sequentially heated by the heating rail 86 and is subsequently pressed against the container sidewall by the tab sealing belt 88. In the preferred embodiment, the sealing belt 88 is of a material that, when exposed to the ambient air temperature, maintains the belt surface at a temperature sufficiently low enough to cause the wax-coated heated tabs 50 to cool and become heat-sealed to the sidewall of the container 20 as it is pressed against the container sidewall by the belt 88.

Though the container assembly apparatus 100, the lid sealing station 64, and the tab-sealing station 66 have been described and shown as a combination of separate, but connected, adjacent units, it is to be understood that they may conveniently take the form of one unitary device comprising one supporting frame and appropriate common conveyor and drive mechanisms.

It is seen that an efficient multi-faced closure applying apparatus is provided by this invention to (1) form square-shaped flexible closure sheets from a bulk roll of sheet material and to apply both a lid and square-shaped closure sheet to an open receptacle simultaneously, and in one motion; and (2) seal projecting tamper-indicating tabs to the side of the lidded receptacle.

From the foregoing, it will be observed that numerous other variations, modifications and rearrangements of the parts may be effected without departing from the true spirit and scope of this invention.

I claim:

1. The method of applying a closure to a receptacle comprising:

moving an open top receptacle along a processing path;

providing a supply of flexible closure sheet and a quantity of stacked lids adjacent the said path; temporarily attaching a lid to a transfer member adjacent to said processing path;

subsequently superposing a length of closure sheet in surface contact on said lid to form a two-ply assembly and attaching portions of said sheet extending beyond said lid to said transfer member;

severing said length of sheet from said supply; moving said transfer member to position said assembly of said lid and associated severed length of closure sheet into vertical alignment with an open top receptacle; effecting relative movement between said receptacle and said assembly of said lid and associated severed length of closure sheet, whereby said lid and associated severed length of closure sheet are simultaneously seated within the open top of said receptacle; and releasing the temporary attachment between said transfer member, lid and length of closure sheet.

2. The method in accordance with claim 1 in which said quantity of lids is provided by a stack of lids in a dispensing mechanism above said path and said closure sheet is provided by a roll of sheet material, and wherein said method includes the further steps of rotating said transfer member to a position beneath said dispensing mechanism, withdrawing a lid from the bottom of the stack and temporarily attaching it to the transfer mechanism, guiding a strip of closure sheet from said roll into adjacency with said transfer member and temporarily attaching it thereto, and rotating said transfer member into a position vertically above said open top receptacle.

3. The method in accordance with claim 2 in which said withdrawing step is performed by moving a pick-up member associated with said transfer member upwardly into engagement with the lowermost lid in said stack, applying vacuum to said pick-up member to temporarily attach the lowermost lid thereto, and retracting said pick-up member to a clearance position below said stack.

4. The method in accordance with claim 1 in which said temporary attachment step is performed by applying vacuum to a surface of said transfer member, and said step of releasing the temporary attachment is performed by interrupting the application of vacuum.

5. The method in accordance with claim 4 in which said lids are generally circular and said severing step is performed by cutting said sheet into a square shape having a transverse dimension greater than the diameter of said lids, said vacuum applying step being performed in part by applying vacuum to portions of said sheet extending beyond the edge of a lid.

6. The method in accordance with claim 1 in which said step of effecting relative movement between said receptacle and said lid and associated severed length of closure sheet is performed by moving said lid and associated severed length of closure film downwardly relative to said receptacle.

7. The method of applying a closure to a receptacle comprising:

moving an open top receptacle along a processing path;

providing a roll of flexible closure sheet and a stack of lids adjacent to said path; rotating a transfer member adjacent to said processing path to a lid pick-up position beneath said stack of lids; moving a pick-up member associated with said transfer member upwardly into engagement with the lowermost lid in said stack;

applying vacuum through said pick-up member to the lowermost lid in said stack to temporarily attach said lowermost lid thereto;

lowering said pick-up member and attached lid to a clearance position below said stack; guiding said film into a position adjacent said transfer member downstream of said lid pick-up station;

rotating said transfer member and attached lid from said pick-up position to a closure sheet pick-up position wherein said lid is aligned adajcent said sheet and portions of said sheet extend beyond the periphery of said lid;

applying vacuum through said transfer member to portions of said sheet extending beyond said lid to temporarily attach the sheet to the transfer member in superposed surface contact relationship with respect to the lid on said pick-up member to form a two-ply assembly; severing said length of sheet from said roll;

rotating said transfer member to a closure applying position wherein said assembly of said lid and associated severed length of closure sheet are positioned in vertical alignment above an open top receptacle; moving said pick-up member downwardly whereby said assembly of said lid and associated severed length of closure sheet are simultaneously seated within the open top of said receptacle;

and releasing the vacuum to detach said lid and length of closure sheet from said pick-up member and said transfer member.

8. The method in accordance with claim 7 in which said step of severing said length of sheet includes first rotating said transfer member and attached lid and attached superposed sheet from said closure sheet pick-up position to a severing position.

9. The method in accordance with claim 7 in which said pick-up member is moved upwardly after said lid and length of closure sheet have been detached.

10. The method in accordance with claim 7 in which said lids are generally circular and said severing step is performed by cutting said sheet into a square shape having a transverse dimension greater than the diameter of said lids, said step of applying vacuum through said pick-up member to said sheet being performed in part by applying vacuum to portions of said sheet extending beyond the edge of a lid.

11. An apparatus for applying a closure to a receptacle comprising:

a frame means mounted on said frame for moving an open top receptacle along a processing path;

means for providing a supply of stacked lids adjacent said path;

means for providing a strip of flexible closure sheet adjacent said processing path;

means for severing a length of sheet from said strip; and transfer means for receiving a lid from said supply of lids and for superposing a severed length of closure sheet in surface contact on said lid to form a two-ply assembly with portions of said sheet extending beyond said lid attached to said transfer means and for subsequently simultaneously applying said assembly of said lid and said length of sheet to an open top of said receptacle.

12. Apparatus in accordance with claim 11 in which said means for moving an open top receptacle along a processing path is an intermittently driven conveyor.

13. Apparatus in accordance with claim 11 in which said means for providing a supply of lids adjacent said path is a lid dispensing assembly mounted above said path and containing a stack of lids.

14. Apparatus in accordance with claim 11 in which said means for providing a strip of flexible closure sheet adjacent said processing path is a bulk roll dispensing assembly mounted above said path.

15. Apparatus in accordance with claim 11 in which said transfer means is an assembly mounted for rotation about a horizontal axis beneath said means for providing a supply of lids and above said processing path, and includes means for receiving a lid from said supply, whereby upon rotation of said assembly lids are transferred into position vertically above an open top container on said path.

16. Apparatus in accordance with claim 15 in which said assembly is a drum having an exterior shape in the form of a regular prism having a base at each end thereof and a plurality of faces extending between said bases, said horizontal rotation axis passing through the center of each base.

17. Apparatus in accordance with claim 16 in which said drum has an exterior shape in the form of a hexagonal prism.

18. Apparatus in accordance with claim 17 in which each exterior face of said drum comprises a rectangular closure sheet carrier plate for receiving a superposed length of flexible closure sheet.

19. Apparatus in accordance with claim 18 further comprising a lid carrier plate carried by said closure sheet carrier plate and presenting a circular disc portion for holding a lid.

20. Apparatus in accordance with claim 21 in which said rectangular closure sheet carrier plate has a recessed circular seat adapted to seat said lid carrier plate.

21. Apparatus in accordance with claim 20 in which said sheet carrier plate and said lid carrier plate have exterior surfaces with apertures communicating with means for applying vacuum to hold a lid to the exterior surface of said lid carrier plate and to hold a length of said sheet to the exterior surface of said sheet carrier plate, said length of sheet being superposed upon, and extending beyond the periphery of said lid and said lid carrier plate.

22. Apparatus in accordance with claim 21 in which said circular disc portion of said lid carrier plate is movable from a seated position in said seat in said sheet carrier plate to an extended position displaced outwardly from said sheet carrier plate for picking up a lid from said supply of lids and for simultaneously applying a lid and a superposed length of sheet to an open top of a receptacle.

23. Apparatus in accordance with claim 22 in which a portion of said lid carrier plate passes through said sheet carrier plate and is secured to a slide bar which extends the length of the drum parallel to the axis of the drum.

24. Apparatus in accordance with claim 23 in which said drum has an end plate on each end, each said end plate having six radially oriented slots, said slide bar having one end slidably disposed in one slot of one of said end plates and the other end slidably disposed in one slot of the other of said end plates.

25. Apparatus in accordance with claim 24 further comprising a roller on each end of said slide bar and a fixed circular guideway adjacent each said end plate for receiving said rollers to accommodate drum rotation.

26. Apparatus in accordance with claim 25 including a pair of opposed movable wedge members adjacent each said end plate, each wedge member having a guideway segment for receiving said rollers and each mounted for movement radially outward from a position in alignment with said fixed circular guideway to a position beyond said fixed circular guideway.

27. Apparatus in accordance with claim 26 further comprising a drive means for moving said wedge members whereby one of said slide bars is movable to effect the movement of one of said lid carrier plates between said seated position and said 28. Apparatus in accordance with claim 18 in which said means for providing a strip of flexible closure sheet adjacent said processing path is a bulk roll dispensing assembly mounted above said path adjacent said drum to orient a strip of closure sheet adjacent a face of said drum and in which said means for severing a length of sheet from said strip is a cutter blade mounted for movement towards said drum whereby said strip is cut when said cutter blade bears against said strip on said drum.

29. Apparatus for applying a closure to a receptacle comprising: a frame; conveyor means mounted for movement relative to said frame, and adapted to support thereon open ended receptacles; drive means for intermittently moving said conveyor and said receptacles thereon along a processing path; a drum assembly mounted in said frame for rotation about a horizontal axis above said conveyor, the lower peripheral portion of said drum assembly being located immediately above said processing path at a closure applying station; a plurality of closure sheet carrier plates mounted on the periphery of said drum assembly, each closure sheet carrier plate having a recessed seat therein, and each closure sheet carrier plate having an external surface with at least one aperture therein; a plurality of lid carrier plates each mounted in one recessed seat and adapted for movement from a seated position to an extended position outwardly displaced from said seat, each lid carrier plate having an exterior surface with at least one aperture therein; a vacuum source; means establishing communication between said vacuum source and the apertures in said lid carrier plates and the closure sheet carrier plates; means for moving said lid carrier plates between said seated and extended positions when said drum assembly is rotated to a position where said lid carrier plates face upwardly and downwardly; a lid dispensing assembly mounted upon said frame directly above said drum assembly, said lid dispensing assembly containing therein a stack of lids, said stack of lids being positioned such that the lowermost lid in the stack is located at a lid pick-up station where it is engaged by a lid carrier plate when it is in the extended position above said drum assembly, whereby vacuum present at the external surface of said extended lid carrier plate attaches a lid thereto; a closure sheet strip bulk roll dispensing assembly mounted on said frame; guide means parallel to the axis of said drum assembly for guiding said closure sheet strip toward a closure sheet pick-up station in tangential adjacency with one closure sheet carrier plate and in superposed relationship with respect to a lid attached to the associated lid carrier plate, whereby vacuum present at the external surface of said one sheet carrier plate attaches said closure sheet strip thereto; a cutter blade mounted at a cutting station for movement toward and away from said drum assembly for cutting said strip once the cutter blade bears against and strip on said drum assembly; means for intermittently rotating said drum assembly from said lid pick-up station to said closure sheet pick-up station, to said cutting station, and to said closure applying station; and means for interrupting the vacuum at the external surfaces of said lid carrier plate when it is at the closure applying station, whereby downward movement of the lid carrier plate at the closure applying station to said extended position moves said lid against said cut closure sheet to lift said cut closure sheet from the surface of said closure sheet carrier plate and applies the lid and cut closure sheet to the open end of a receptacle.

30. Apparatus in accordance with claim 29, in which said lid carrier plate has a circular disc portion for holding a lid; in which said recessed seat is circular and adapted to seat said disc portion of said lid carrier plate; and in which said sheet carrier plate and said lid carrier plate have exterior surfaces with plural apertures communicating with said vacuum source.

31. Apparatus in accordance with claim 30, in which a portion of said lid carrier plate passes through said sheet carrier plate and is secured to a slide bar which extends the length of the drum assembly parallel to the axis of the drum assembly; and in which said drum assembly has an end plate on each end, each said end plate having six radially oriented slots, said slide bar having one end slidably disposed in one slot of one of said end plates and the other end slidably disposed in one slot of the other of said end plates.

32. Apparatus in accordance with claim 31, including a roller on each end of said slide bar; including a pair of opposed fixed truncated sector members each having a fixed arcuate guideway for receiving said rollers to accommodate drum rotation; including a pair of opposed movable wedge members adjacent each said end plate, each wedge member disposed between said opposed fixed truncated sector members and having an arcuate guideway for receiving said rollers, each wedge member mounted for movement outward from a position in alignment with said fixed guideways to a position beyond said fixed guideways; and including linkage means with said drive means for moving said wedge members outwardly to carry said rollers outwardly, whereby one of said slide bars is moved in two of said slots to effect the movement of one of said lid carrier plates between said seated position and said extended position at said lid pick-up station and whereby another of said slide bars is simultaneously moved in another two slots to effect the movement of one of said lid carrier plates between said seated position and said extended position at said closure applying station.

33. Apparatus in accordance with claim 29, in which said receptacles have a sidewall that is circular in cross-section, said cutting blade has a straight cutting edge disposed perpendicularly with respect to the length of said closure sheet strip for severing the strip into quadrilateral lengths having transverse dimensions greater than the diameter of the open top of said receptacle, whereby closure sheet tabs project outwardly beyond the margin of the lid when it is applied to a receptacle.

34. Apparatus in accordance with claim 33, further comprising: conveyor means for moving said receptacle in upright orientation along a process path, including means on said processing path for bearing against said projecting tabs to deflect them downwardly alongside said sidewall; first sealing means for applying heat to said tabs; and second sealing means cooperating with said first sealing means for pressing the heated tabs against the sidewall to secure the tabs to the sidewall.

35. Apparatus in accordance with claim 34, in which said means for bearing against said projecting corners includes a disc having a cylindrical depending peripheral flange for extending below said lid and adjacent said tabs for engaging said tabs beyond the periphery of said lid.

36. Apparatus in accordance with claim 34, in which said first sealing means comprises a rail on one side of said process path for engaging one side of said receptacle, said rail having means for being heated along a portion of the length thereof, and in which said second sealing means comprises a movable sealing belt means for engaging one side of said sidewall on the side of said processing path opposite said rail so that said receptacles are rolled along said rail while moving along the processing path.

* * * * *